US006199535B1

(12) United States Patent
Hara

(10) Patent No.: US 6,199,535 B1
(45) Date of Patent: Mar. 13, 2001

(54) THROTTLE CONTROL FOR INTERNAL COMBUSTION ENGINE HAVING FAILURE DETECTION FUNCTION

(75) Inventor: Mitsuo Hara, Ichinomiya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/568,137

(22) Filed: May 10, 2000

(30) Foreign Application Priority Data

May 13, 1999 (JP) ..... 11-132094
May 14, 1999 (JP) ..... 11-133608

(51) Int. Cl.[7] ..... F02D 1/00
(52) U.S. Cl. ..... 123/396; 123/399
(58) Field of Search ..... 123/396, 399; 477/206

(56) References Cited

U.S. PATENT DOCUMENTS 4,603,675 8/1986 Junginger et al. .
5,048,484 * 9/1991 Terazawa et al. ..... 123/396
5,950,597 9/1999 Kamio et al. .
6,047,679 * 4/2000 Matsumoto et al. ..... 123/396
6,073,610 * 6/2000 Matsumoto et al. ..... 123/396

FOREIGN PATENT DOCUMENTS 6-249015 9/1994 (JP) .
8-23312 3/1996 (JP) .

* cited by examiner

*Primary Examiner*—John Kwon
(74) *Attorney, Agent, or Firm*—Nixon & Vanderhye P.C.

(57) ABSTRACT

A throttle valve for an engine is disabled to be driven by an actuator by limiting a target throttle angle upper limit of a target throttle angle, when a failure is detected by an electronic control unit. Then, the target throttle angle is returned to a value used at a normal time at a restoration timing of a restoration of the system to a normal state or while the opening speed of a throttle valve at a restoration is being restrained. Thus, an abrupt opening operation of the throttle valve in response to the depression carried out by the driver on an accelerator pedal. Further, the throttle valve is driven in a limp-home operation mode by controlling the reduced number of operating cylinders of the engine. The reduced number of operating cylinders is increased or the operations of all cylinders are halted, when the engine speed rises above a predetermined value.

20 Claims, 26 Drawing Sheets

THROTTLE CONTROL FOR INTERNAL COMBUSTION ENGINE HAVING FAILURE DETECTION FUNCTION

CROSS REFERENCE TO RELATED APPLICATION

This application relates to and incorporates herein by reference Japanese Patent Applications No. 11-132094 filed on May 13, 1999 and No. 11-133608 filed on May 14, 1999.

BACKGROUND OF THE INVENTION

The present invention relates to a throttle control for an internal combustion engine and used for controlling an opening of a throttle valve by driving an actuator in accordance with a depression position of an accelerator pedal. More particularly, the present invention relates to a throttle control which performs a restoration or limp-home operation in the event of a system failure.

A conventional throttle control apparatus employed in an internal combustion engine (electronic throttle system) for controlling an opening of a throttle valve drives an actuator in accordance with the depression position of an accelerator pedal. The throttle control apparatus controls the amount of intake air supplied to the internal combustion engine by opening and closing the throttle valve in an operation to drive the actuator in accordance with a signal generated by an accelerator position sensor for detecting a position of an accelerator corresponding to the depression position of the accelerator pedal.

As is generally known, the electronic throttle system has a fail-safe function which is used for preventing an engine speed of the internal combustion engine from abruptly rising by temporarily cutting off a current supplied to the actuator when some abnormalities or failures occur in the electronic control system.

In case occurrence of a failure is once detected in the electronic throttle system but later the failure detection is determined to be an erroneous detection attributed to sensor noise or the like, it is desirable to resume a supply of a current to the actuator and to restore the control after verification of a normal operation.

A driver encountering an abnormal condition like the above one may possibly depresses the accelerator pedal a plurality of times without regard to an operating condition that exists at that time in an attempt to grasp an abnormal condition. Thereby, with the accelerator pedal depressed, the engine speed of the internal combustion engine rises abruptly when the electronic control system is restored from the abnormal condition to the normal condition. As a result, it is likely that a vehicle performs an improper operation.

It is proposed in JP-A-6-249015 to reduce the number of operating cylinders of the internal combustion engine to decrease the output of the internal combustion engine in the event of occurrence of failure. Thus, a vehicle is enabled to be driven in a limp-home operation manner.

However, the limp-home operation becomes impossible even if only one of the accelerator position sensor and the throttle angle sensor fails. In addition, the limp-home operation also becomes impossible in the event of a throttle control failure wherein the throttle valve can not be closed even after a predetermined period of time has elapsed since restoration of the accelerator pedal.

SUMMARY OF THE INVENTION

It is thus an object of the present invention to provide a throttle control which prevents a vehicle from an improper operation by restricting an abrupt opening operation of a throttle valve or by regulating a restoration timing to return an electronic throttle system from an abnormal condition to a normal condition.

It is another object of the present invention to provide a throttle control which improves running stability by avoiding an abrupt increase in internal combustion engine speed while ensuring a limp-home performance in the event of a failure.

According to a first aspect of the present invention, an upper limit of a target throttle angle is restrained to be smaller than a predetermined value in the event of an occurrence of failure in a throttle control, and the target throttle angle restrained is restored to a value used in a normal time when the throttle control means is restored to a normal state. Preferably, the upper limit of the target throttle angle is restored to a value used at a normal time when the target throttle angle becomes smaller than the predetermined throttle angle or the actual throttle angle. The upper limit of the target throttle angle is increased gradually.

According to a second aspect of the present invention, the number of operating cylinders of an internal combustion engine is reduced upon occurrence of failure in a throttle control, and a lower limit of the reduced cylinder count is limited. Preferably, the reduced cylinder count is varied in accordance with the state of a depression of a brake pedal and a position of an accelerator pedal.

BRIEF DESCRIPTION OF THE DRAWINGS

Other objects, features and advantages of the present invention will become more apparent from the following detailed description made with reference to the accompanying drawings. In the drawings.

DETAILED DESCRIPTION OF THE PREFERRED EMBODIMENT

Figure 1:
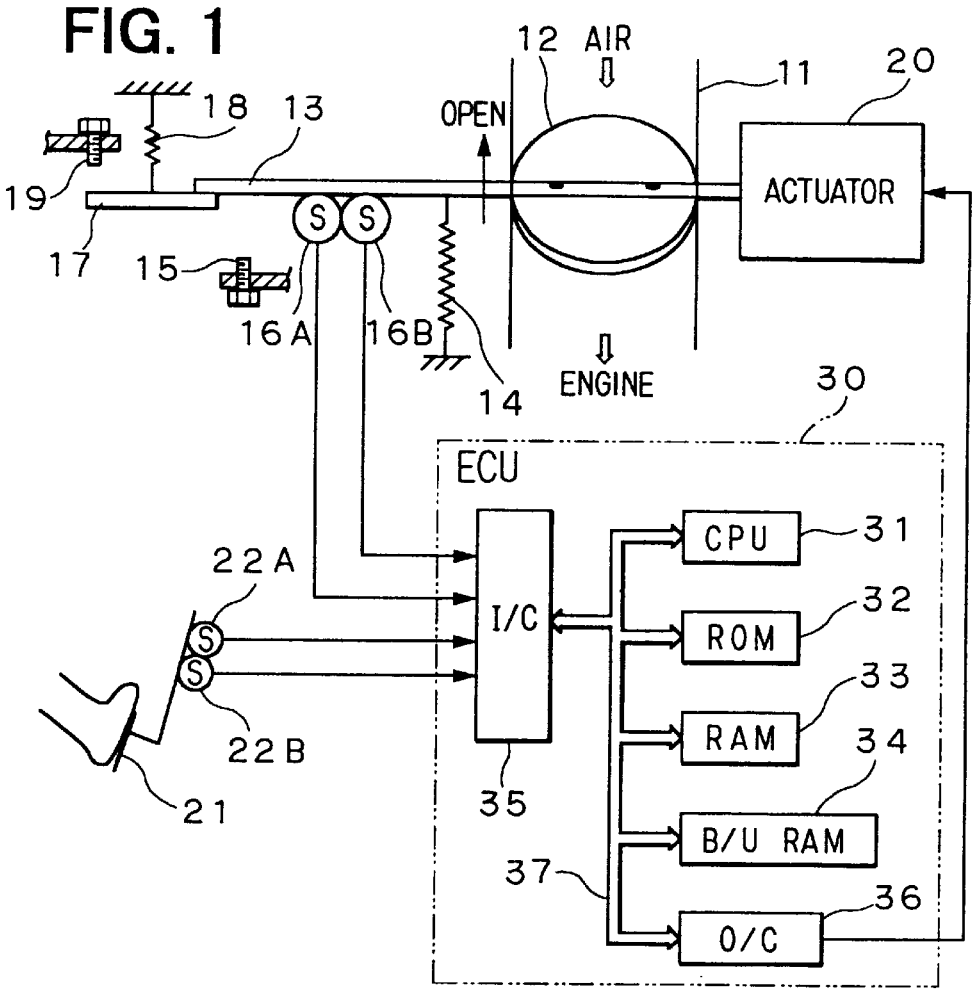
FIG. 1 is a schematic diagram showing a throttle control apparatus of an internal combustion engine implemented in a first embodiment of the present invention.

The present invention will be described in further detail with reference to various embodiments and modifications in which the same parts or processes are designated with the same reference numerals.

First Embodiment

A throttle control apparatus according to a first embodiment is directed to an improved restoration of a throttle valve operation after a detection of throttle failure. The first embodiment is constructed as shown in FIG. 1.

Air is supplied through an intake pipe 11 to an internal combustion engine (not shown). A throttle valve 12 is provided at a middle position of the intake pipe 11. The throttle valve 12 is fixed on a throttle shaft 13 and naturally pressed by a return spring 14 to a fully-closed side through the throttle shaft 13. It should be noted that the fully-closed position of the throttle valve 12 is regulated by a full closure stopper 15 through the throttle shaft 13. In addition, the throttle valve 12 is provided with a dual sensor system comprising throttle angle sensors 16A and 16B which are arranged at locations adjacent to each other. The dual sensor system detects the opening of the throttle valve 12 through the throttle shaft 13.

The throttle valve 12 is engaged with an opener 17 through the throttle shaft 13. The throttle valve 12 is normally biased by an opener spring 18 to an open side through the throttle shaft 13 and the opener 17. The open position of the opener 17 is regulated by an opener stopper 19. The opener stopper determines a minimum throttle opening angle with which the engine is enabled to run so that a vehicle is capable of traveling in a limp-home drive operation.

An actuator 20 implemented typically by a DC motor is further provided on the throttle shaft 13 of the throttle valve 12. The biasing force of the opener spring 18 overcomes the pressing force of the return spring 14. Thus, in an electrically nonconductive state with no current supplied to the actuator 20, the throttle angle of the throttle valve 12 is set with the throttle valve 12 brought into contact by the opener 17 with the opener stopper 19 through the throttle shaft 13.

An accelerator pedal 21 has another dual sensor system. The other dual sensor system comprises accelerator position sensors 22A and 22B arranged at locations adjacent to each other. The other dual sensor system detects the accelerator position of the accelerator pedal 21.

An ECU (electronic control unit) 30 receives throttle angle signals from the throttle angle sensors 16A and 16B of the throttle dual sensor system and accelerator position signals from the accelerator position sensors 22A and 22B of the accelerator dual sensor system. The ECU 30 includes a CPU 31 serving as a generally known central processing unit, a ROM 32 for storing a control program, a RAM 33 for storing various kinds of data, a B/U (backup) RAM 34, an input circuit 35 and an output circuit 36 which are connected to each other by a bus line 37. In such a configuration, the ECU 30 outputs a driving signal based on a variety of sensor signals to the actuator 20 which in turn sets the throttle valve 12 at an opening position supplying a proper amount of air to the internal combustion engine.

Figure 2:
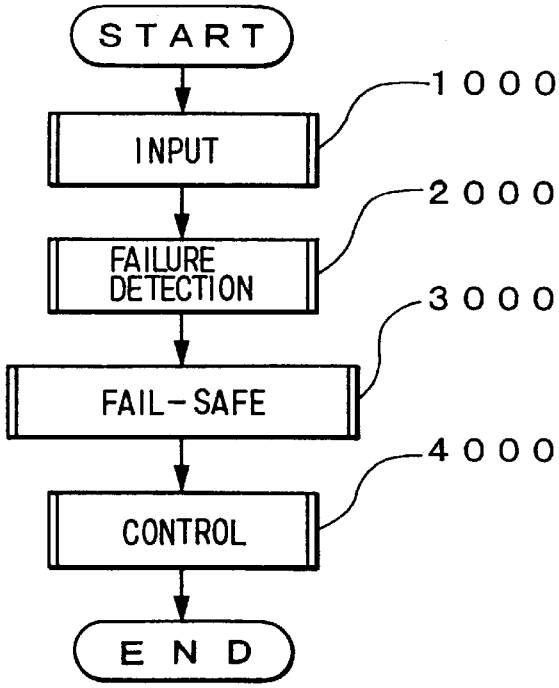
FIG. 2 is a flow diagram showing a base routine executed by a CPU employed in an ECU used in the first embodiment.

The ECU 30, particularly the CPU 31, is programmed to execute a base routine shown in FIG. 2. It should be noted that this base routine is periodically executed by the CPU 31 at intervals of 10 ms after the power supply is turned on by turning on an ignition switch (not shown).

As shown in the figure, the processing begins with a step 1000 at which input processing is carried out to acquire input signals generated by a variety of sensors. Then, the flow of the procedure proceeds to a next step 2000 at which failure detection processing is carried out to detect a throttle failure and an accelerator failure, if any. Subsequently, the flow of the procedure proceeds to a next step 3000 at which fail-safe processing is carried out to implement a fail-safe operation in the event of the throttle failure or the accelerator failure. Then, the flow of the procedure proceeds to a next step 4000 at which a throttle control processing is carried out to execute control of the actuator 20 before ending this routine.

Each piece of processing described above is explained in detail as follows.

Figure 3:
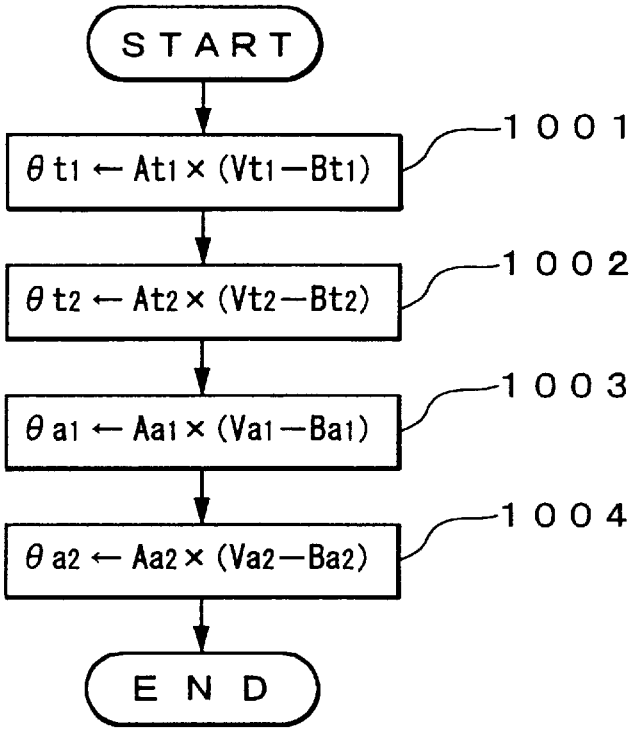
FIG. 3 is a flow diagram showing a procedure of input processing carried out in the first embodiment.
Figure 4:
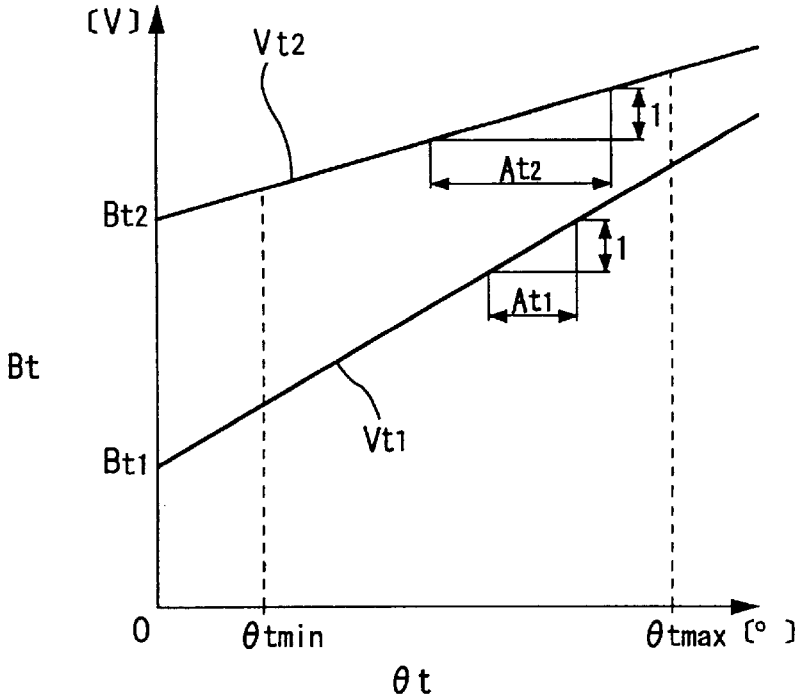
FIG. 4 is a diagram showing characteristic curves representing relations between a throttle angle and a throttle angle sensor voltage for throttle angle sensors of a dual sensor system employed in the first embodiment.
Figure 5:
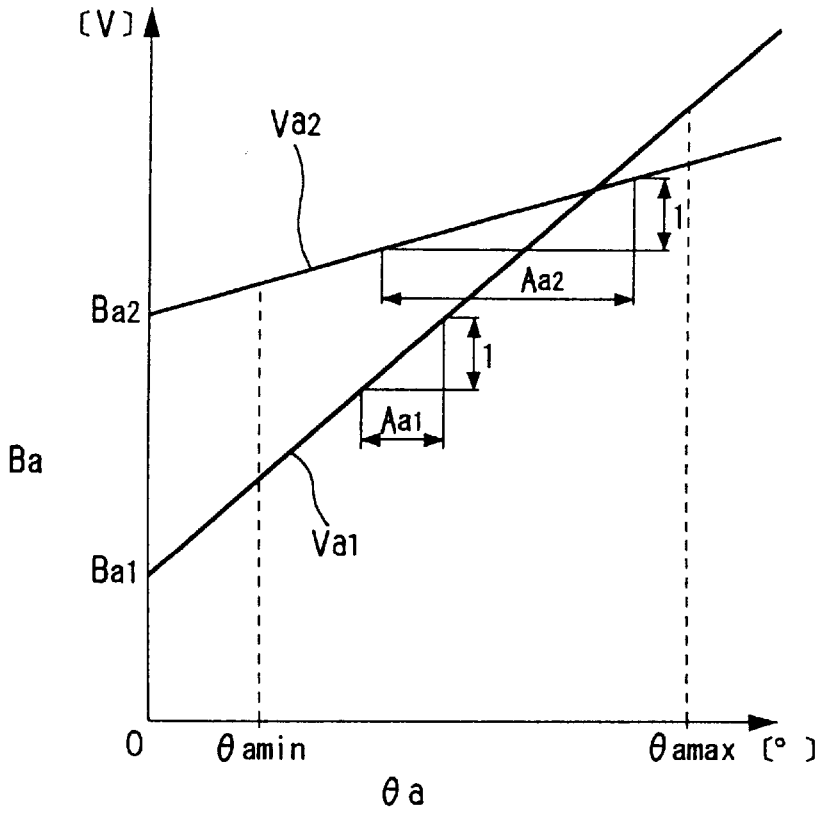
FIG. 5 is a diagram showing characteristic curves representing relations between an accelerator position and the accelerator sensor voltage for accelerator position sensors of another dual sensor system employed in the first embodiment.

First of all, the procedure of the input processing carried out at the step 1000 of the flow diagram shown in FIG. 2 is explained on the basis of a flow diagram shown in FIG. 3 by referring to FIGS. 4 and 5. FIG. 4 is a diagram showing characteristic curves representing relations between the throttle angle θt [°] and the throttle angle sensor voltage Bt [V] for the throttle angle sensors 16A and 16B of the dual sensor system. A symbol θtmax denotes an upper limit of the throttle angle θt while a symbol θtmin denotes a lower limit of the throttle angle θt. A range between the upper and lower limits is a usage range of the throttle angle θt.

On the other hand, FIG. 5 is a diagram showing characteristic curves representing relations between the accelerator position θa [°] and the accelerator sensor voltage Ba [V] for the accelerator position sensors 22A and 22B of the other dual sensor system. A symbol θamax denotes an upper limit of the accelerator position θa while a symbol θamin denotes a lower limit of the accelerator position θa. A range between the upper and lower limits is a usage range of the accelerator position θa. It should be noted that the subroutine of this input processing is periodically executed by the CPU 31 at intervals of 10 ms.

The processing shown in FIG. 3 begins with a step 1001 at which a difference obtained as a result of subtracting a throttle angle sensor offset voltage Bt1 from a throttle angle sensor voltage Vt1 output by the throttle angle sensor 16A of the dual sensor system is multiplied by a coefficient At1 of conversion from a throttle angle sensor voltage into a throttle angle shown in FIG. 4 in order to determine an actual throttle angle θt1. The actual throttle angle θt1 is an actual opening determined from a signal output by the throttle angle sensor 16A and is referred to hereafter simply as a throttle angle θt1.

Then, the flow of the procedure proceeds to a next step 1002 at which a difference obtained as a result of subtracting a throttle angle sensor offset voltage Bt2 from a throttle angle sensor voltage Vt2 output by the throttle angle sensor 16B of the dual sensor system is multiplied by a coefficient At2 of conversion from a throttle angle sensor voltage into a throttle angle shown in FIG. 4 in order to determine an actual throttle angle θt2. The actual throttle angle θt2 is an actual opening determined from a signal output by the throttle angle sensor 16B and is referred to hereafter simply as a throttle angle θt2.

Subsequently, the flow of the procedure proceeds to a next step 1003 at which a difference obtained as a result of subtracting an accelerator sensor offset voltage Bal from an accelerator sensor voltage Va1 output by the accelerator sensor 22A of the other dual sensor system is multiplied by a coefficient Aa1 of conversion from an accelerator sensor voltage into an accelerator position shown in FIG. 5 in order to determine an actual accelerator position θa1. The actual accelerator position θa1 is an actual opening determined from a signal output by the accelerator sensor 22A and is referred to hereafter simply as an accelerator position θa1.

Then, the flow of the procedure proceeds to a next step 1004 at which a difference obtained as a result of subtracting an accelerator sensor offset voltage Ba2 from an accelerator sensor voltage Va2 output by the accelerator sensor 22B of the other dual sensor system is multiplied by a coefficient Aa2 of conversion from an accelerator sensor voltage into an accelerator position shown in FIG. 5 in order to determine an actual accelerator position θa2. The actual accelerator position θa2 is an actual position determined from a signal output by the accelerator sensor 22B and is referred to hereafter simply as an accelerator position θa2.

Figure 6:
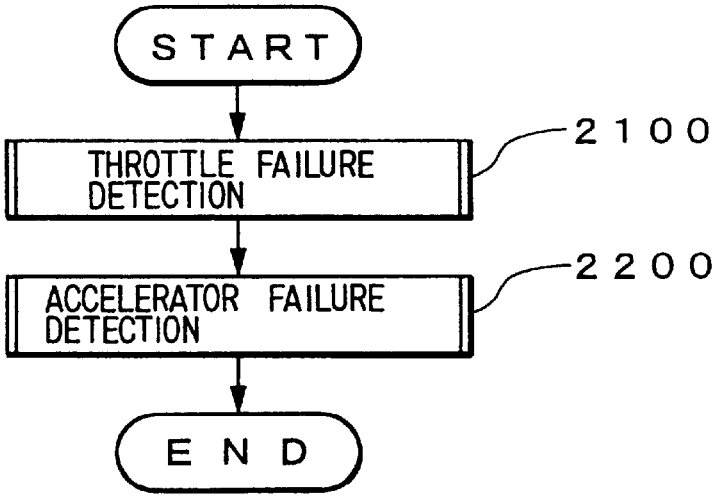
FIG. 6 is a flow diagram showing a procedure of failure detection processing carried out in the first embodiment.

Next, the procedure of the failure detection processing carried out at the step 2000 of the flow diagram shown in FIG. 2 is explained by referring to a flow diagram shown in FIG. 6. It should be noted that the subroutine of this failure detection processing is periodically executed by the CPU 31 at intervals of 10 ms.

The flow diagram shown in FIG. 6 begins with a step 2100 at which throttle failure detection processing to be described later is carried out. Then, the flow of the procedure proceeds to a next step 2200 at which accelerator failure detection processing to be described later is performed before ending this failure detection routine.

Figure 7:
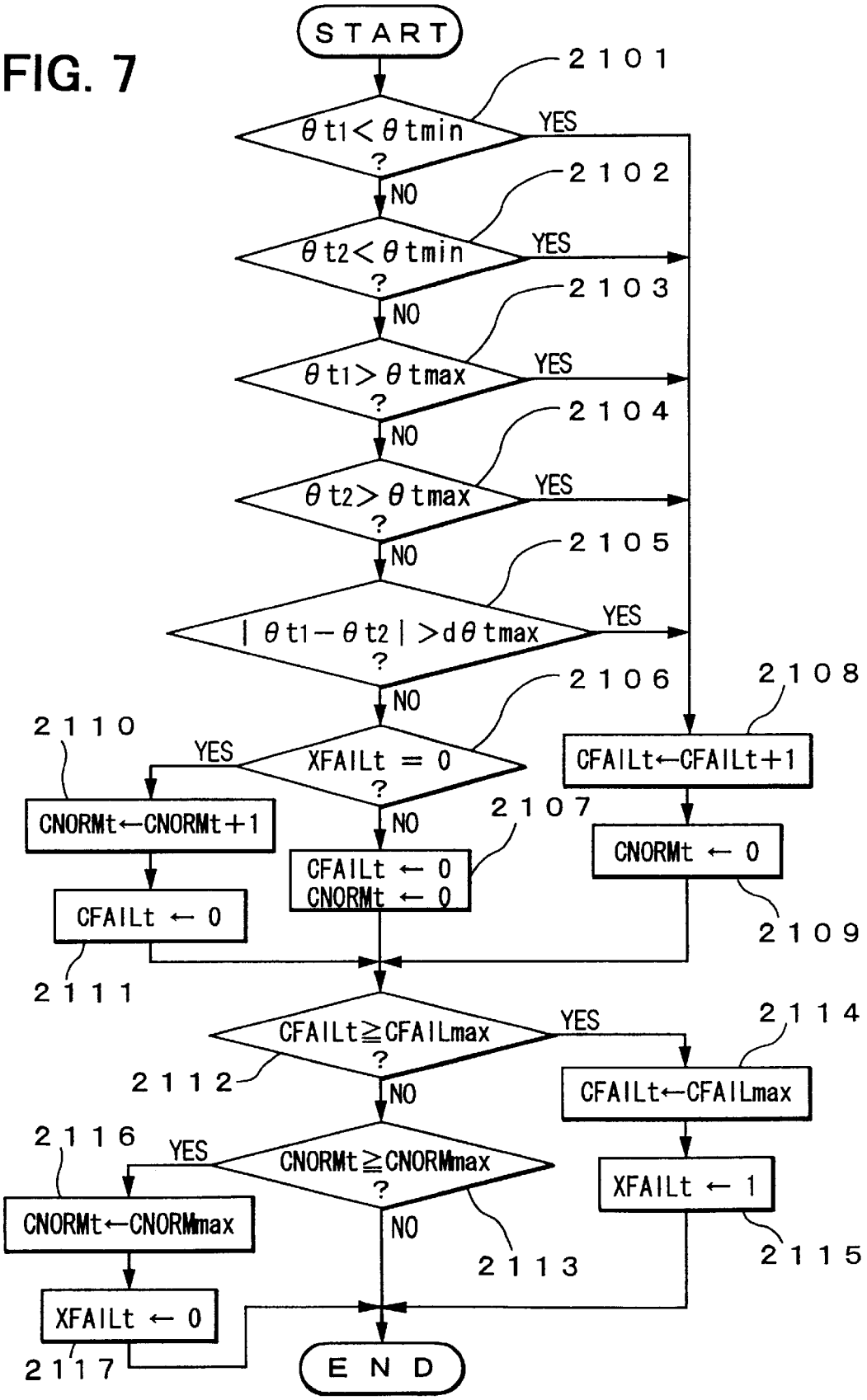
FIG. 7 is a flow diagram showing a procedure of throttle failure detection processing carried out as a step in the flow diagram shown in FIG. 6.

Next, the procedure of the throttle failure detection processing carried out at the step 2100 of the flow diagram shown in FIG. 6 is explained in detail by referring to a flow diagram shown in FIG. 7.

The flow diagram shown in FIG. 7 begins with a step 2101 to determine whether the throttle angle θt1 determined from the throttle angle sensor 16A at the step 1001 of the flow diagram shown in FIG. 3 is smaller than a lower limit θtmin. If the condition of the determination of the step 2101 does not hold true, that is, if the throttle angle θt1 is determined greater than or equal to the lower limit θtmin, the flow of the processing proceeds to a step 2102 to determine whether the throttle angle θt2 determined from the throttle angle sensor 16B at the step 1002 of the flow diagram shown in FIG. 3 is smaller than the lower limit θtmin.

If the condition of the determination of the step 2102 does not hold true, that is, if the throttle angle θt2 is determined greater than or equal to the lower limit θtmin, the flow of the processing proceeds to a step 2103 to determine whether the throttle angle θt1 determined from the throttle angle sensor 16A is greater than an upper limit θtmax. If the condition of the determination of the step 2103 does not hold true, that is, if the throttle angle θt1 is determined smaller than or equal to the upper limit θtmax, the flow of the processing proceeds to a step 2104 to determine whether the throttle angle θt2 determined from the throttle angle sensor 16B is greater than the upper limit θtmax.

If the condition of the determination of the step 2104 does not hold true, that is, if the throttle angle θt2 is determined smaller than or equal to the upper limit θtmax, the flow of the processing proceeds to a step 2105 to determine whether the absolute value of a deviation between the throttle angle θt1 and the throttle angle θt2 is greater than a throttle angle deviation failure criterion value d θtmax. If the condition of the determination of the step 2105 does not hold true, that is, if the absolute value of a deviation between the throttle angle θt1 and the throttle angle θt2 is determined smaller than or equal to the throttle angle deviation failure criterion value d θtmax, the flow of the processing proceeds to a step 2106 to determine whether a throttle failure determination flag XFAILt is reset to 0.

If the condition of the determination of the step 2106 does not hold true, that is, if the throttle failure determination flag XFAILt is set to 1 indicating that the output state of at least one of the throttle angle sensors 16A and 16B of the dual sensor system is unstable, the flow of the processing proceeds to a step 2107 at which a throttle failure determination counter CFAILt and a throttle normality determination counter CNORMt are each cleared to 0.

The flow of the processing proceeds to a step 2108 at which the throttle failure determination counter CFAILt is incremented by 1 when the determination results at steps 2101 to 2106 indicates an out-of-range state. Then, the flow of the procedure proceeds to a next step 2109 at which the throttle normality counter CNORMt is cleared to 0.

This state occurs, if the condition of the determination of the step 2101 holds true, that is, if the throttle angle θt1 is determined smaller than the lower limit θtmin, indicating typically an open-circuit state of the throttle angle sensor 16A, if the condition of the determination of the step 2102 holds true, that is, if the throttle angle θt2 is determined smaller than the lower limit θtmin, indicating typically an open-circuit state of the throttle angle sensor 16B, if the condition of the determination of the step 2103 holds true, that is, if the throttle angle θt1 is determined greater than the upper limit θtmax, indicating typically a short-circuit state of the throttle angle sensor 16A, if the condition of the determination of the step 2104 holds true, that is, if the throttle angle θt2 is determined greater than the upper limit θtmax, indicating typically a short-circuit state of the throttle angle sensor 16B, or if the condition of the determination of the step 2105 holds true, that is, if the absolute value of the deviation between the throttle angle θt1 and the throttle angle θt2 is determined greater than the throttle angle deviation failure criterion value d θtmax.

If the condition of the determination of the step 2106 holds true, that is, if the throttle failure determination flag XFAILt is reset to 0 indicating that both the throttle angle sensors 16A and 16B of the dual sensor system are normal, on the other hand, the flow of the processing proceeds to a step 2110 at which the throttle normality determination counter CNORMt is incremented by 1. Then, the flow of the procedure proceeds to a next step 2111 at which the throttle failure determination counter CFAILt is cleared to 0.

After completing the processing at the step 2107, 2109 or 2111, the flow of the routine then proceeds to a step 2112 to determine whether the throttle failure determination counter CFAILt is equal to or greater than a failure determination counter maximum CFAILmax. If the condition of the determination of the step 2112 does not hold true, that is, if the throttle failure determination counter CFAILt is determined smaller than the failure determination counter maximum CFAILmax, a throttle failure is not determined to exist yet with an effect of noise and the like taken into consideration.

In this case, the flow of the processing proceeds to a step 2113 to determine whether the throttle normality determination counter CNORMt is equal to or greater than a normality determination counter maximum CNORMmax. If the condition of the determination of the step 2113 does not hold true, that is, if the throttle normality determination counter CNORMt is determined smaller than the normality determination counter maximum CNORMmax, a throttle normality condition is not determined to hold true yet. In this case, the throttle failure detection routine is ended.

If the condition of the determination of the step 2112 holds true, that is, if the throttle failure determination counter CFAILt is determined equal to or greater than the failure determination counter maximum CFAILmax, on the other hand, the flow of the processing proceeds to a step 2114 at which the throttle failure determination counter CFAILt is set to the failure determination counter maximum CFAILmax. Then, the flow of the procedure proceeds to a next step 2115 at which the throttle failure determination flag XFAILt is set to 1. That is, a throttle failure is determined to exist and the throttle failure detection routine is ended.

Similarly, if the condition of the determination of the step 2113 holds true, that is, if the throttle normality determination counter CNORMt is determined equal to or greater than the normality determination counter maximum CNORMmax, on the other hand, the flow of the processing proceeds to a step 2116 at which the throttle normality determination counter CNORMt is set to the normality determination counter maximum CNORMmax. Then, the flow of the procedure proceeds to a next step 2117 at which the throttle failure determination flag XFAILt is set to 0. That is, the throttle valve is determined to be normal and the throttle failure detection routine is ended.

Figure 8:
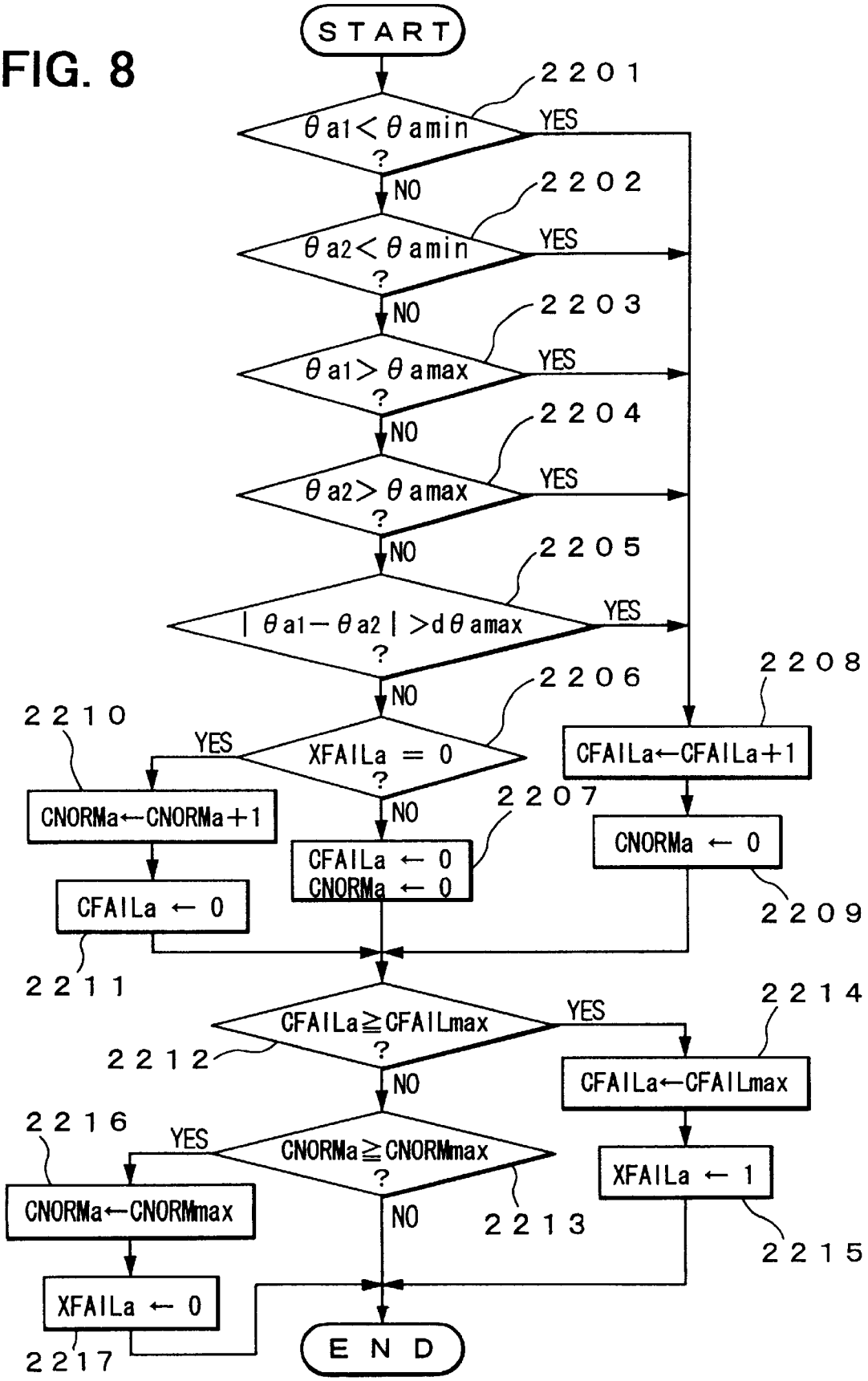
FIG. 8 is a flow diagram showing a procedure of accelerator failure detection processing carried out as a step in the flow diagram shown in FIG. 6.

Next, the procedure of the accelerator failure detection processing carried out at the step 2200 of the flow diagram shown in FIG. 6 is explained in detail by referring to a flow diagram shown in FIG. 8.

The flow diagram shown in FIG. 8 begins with a step 2201 to determine whether the accelerator position θa1 determined from the accelerator position sensor 22A at the step 1003 of the flow diagram shown in FIG. 3 is smaller than a lower limit θamin. If the condition of the determination of the step 2201 does not hold true, that is, if the accelerator position θa1 is determined greater than or equal to the lower limit θamin, the flow of the processing proceeds to a step 2202 to determine whether the accelerator position θa2 determined from the accelerator position sensor 22B at the step 1004 of the flow diagram shown in FIG. 3 is smaller than the lower limit θamin.

If the condition of the determination of the step 2202 does not hold true, that is, if the accelerator position θa2 is determined greater than or equal to the lower limit θamin, the flow of the processing proceeds to a step 2203 to determine whether the accelerator position θa1 determined from the accelerator position sensor 22A is greater than an upper limit θamax. If the condition of the determination of the step 2203 does not hold true, that is, if the accelerator position θa1 is determined smaller than or equal to the upper limit θamax, the flow of the processing proceeds to a step 2204 to determine whether the accelerator position θa2 determined from the accelerator position sensor 22B is greater than the upper limit θamax.

If the condition of the determination of the step 2204 does not hold true, that is, if the accelerator position θa2 is determined smaller than or equal to the upper limit θamax, the flow of the processing proceeds to a step 2205 to determine whether the absolute value of a deviation between the accelerator position θa1 and the accelerator position θa2 is greater than an accelerator position deviation failure criterion valued θamax. If the condition of the determination of the step 2205 does not hold true, that is, if the absolute value of a deviation between the accelerator position θa1 and the accelerator position θa2 is determined smaller than or equal to the accelerator position deviation failure criterion value d θamax, the flow of the processing proceeds to a step 2206 to determine whether an accelerator failure determination flag XFAILa is reset to 0.

If the condition of the determination of the step 2206 does not hold true, that is, if the accelerator failure determination flag XFAILa is set to 1 indicating that the output state of at least the accelerator position sensor 22A or 22B of the other dual sensor system is unstable, the flow of the processing proceeds to a step 2207 at which an accelerator failure determination counter CFAILa and an accelerator normality determination counter CNORMa are each cleared to 0.

The flow of the processing proceeds to a step 2208 at which the accelerator failure determination counter CFAILa is incremented by 1 when the determination results in steps 2201 to 2206 indicate an out-of-range state. The flow of the is procedure proceeds to a next step 2209 at which the accelerator normality counter CNORMa is cleared to 0.

This state occurs, if the condition of the determination of the step 2201 holds true, that is, if the accelerator position θa1 is determined smaller than the lower limit θamin, indicating typically an open-circuit state of the accelerator position sensor 22A, if the condition of the determination of the step 2202 holds true, that is, if the accelerator position θa2 is determined smaller than the lower limit θamin, indicating typically an open-circuit state of the accelerator position sensor 22B, if the condition of the determination of the step 2203 holds true, that is, if the accelerator position θa1 is determined greater than the upper limit θamax, indicating typically a short-circuit state of the accelerator position sensor 22A, if the condition of the determination of the step 2204 holds true, that is, if the accelerator position θa2 is determined greater than the upper limit θamax, indicating typically a short-circuit state of the accelerator position sensor 22B, or if the condition of the determination of the step 2205 holds true, that is, if the absolute value of the deviation between the accelerator position θa1 and the accelerator position θa2 is determined greater than the accelerator position deviation failure criterion value d θamax.

If the condition of the determination of the step 2206 holds true, that is, if the accelerator failure determination flag XFAILa is reset to 0 indicating that both the accelerator li5 position sensors 22A and 22B of the other dual sensor system are normal, on the other hand, the flow of the processing proceeds to a step 2210 at which the accelerator normality determination counter CNORMa is incremented by 1. Then, the flow of the procedure proceeds to a next step 2211 at which the accelerator failure determination counter CFAILa is cleared to 0.

After completing the processing at the step 2207, 2209 or 2211, the flow of the routine then proceeds to a step 2212 to determine whether the accelerator failure determination counter CFAILa is equal to or greater than the failure determination counter maximum CFAILmax. If the condition of the determination of the step 2212 does not hold true, that is, if the accelerator failure determination counter CFAILa is determined smaller than the failure determination counter maximum CFAILmax, an accelerator failure is not determined to exist yet with an effect of noise and the like taken into consideration. In this case, the flow of the processing proceeds to a step 2213 to determine whether the accelerator normality determination counter CNORMa is equal to or greater than the normality determination counter maximum CNORMmax.

If the condition of the determination of the step 2213 does not hold true, that is, if the accelerator normality determination counter CNORMa is determined smaller than the normality determination counter maximum CNORMmax, an accelerator normality is not determined to hold true yet. In this case, the accelerator failure detection routine is ended.

If the condition of the determination of the step 2212 holds true, that is, if the accelerator failure determination counter CFAILa is determined equal to or greater than the failure determination counter maximum CFAILmax, on the other hand, the flow of the processing proceeds to a step 2214 at which the accelerator failure determination counter CFAILa is set to the failure determination counter maximum CFAILmax. Then, the flow of the procedure proceeds to a next step 2215 at which the accelerator failure determination flag XFAILa is set to 1. That is, an accelerator failure is determined to exist and the accelerator failure detection routine is ended.

Similarly, if the condition of the determination of the step 2213 holds true, that is, if the accelerator normality determination counter CNORMa is determined equal to or greater than the normality determination counter maximum CNORMmax, on the other hand, the flow of the processing proceeds to a step 2216 at which the accelerator normality determination counter CNORMa is set to the normality determination counter maximum CNORMmax. Then, the flow of the procedure proceeds to a next step 2217 at which the accelerator failure determination flag XFAILa is set to 0. That is, the accelerator valve is determined to be normal and the accelerator failure detection routine is ended.

Figure 9:
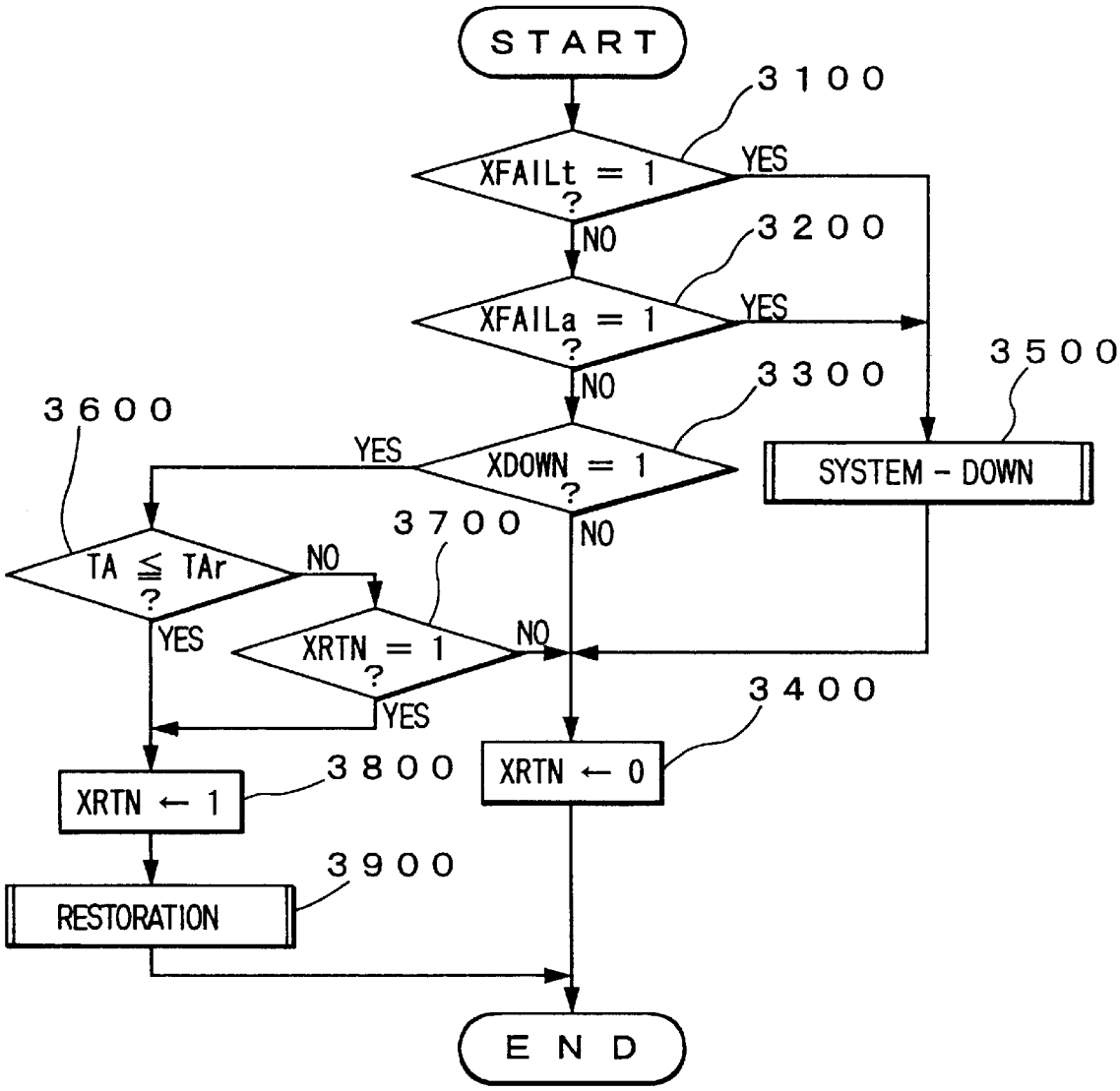
FIG. 9 is a flow diagram showing a procedure of fail-safe processing carried out in the first embodiment.

Next, the procedure of the fail-safe processing carried out at the step 3000 of the flow diagram shown in FIG. 2 is explained in detail by referring to a flow diagram shown in FIG. 9. It should be noted that this failure detection processing is periodically executed by the CPU 31 at intervals of 10 ms.

The flow diagram shown in FIG. 9 begins with a step 3100 to determine whether the throttle failure determination flag XFAILt is set to 1. If the condition of the determination of the step 3100 does not hold true, that is, if the throttle failure determination flag XFAILt is reset to 0, indicating that both the throttle angle sensors 16A and 16B of the dual sensor system are normal, the flow of the procedure proceeds to a step 3200 to determine whether the accelerator failure determination flag XFAILa is set to 1.

If the condition of the determination of the step 3200 does not hold true, that is, if the accelerator failure determination flag XFAILa is reset to 0, indicating that both the accelerator position sensors 22A and 22B of the dual sensor system are normal, the flow of the procedure proceeds to a step 3300 to determine whether a system-down processing flag XDOWN is set to 1. If the condition of the determination of the step 3300 does not hold true, that is, if the system-down processing flag XDOWN is reset to 0, indicating that system-down processing to be described later has not been carried out yet, the flow of the procedure proceeds to a step 3400 at which a restoration processing permit flag XRTN is set to 0.

On the other hand, the flow of the procedure proceeds to a step 3500, if the condition of the determination of the step 3100 holds true, that is, if the throttle failure determination flag XFAILt is set to 1, indicating that at least one of the throttle angle sensors 16A and 16B of the dual sensor system is abnormal or, if the condition of the determination of the step 3200 holds true, that is, if the accelerator failure determination flag XFAILa is set to 1, indicating that at least one of the accelerator position sensors 22A and 22B of the other dual sensor system is abnormal, At the step 3500, the system-down processing to be described later is carried out. The flow of the procedure then proceeds to a step 3400 at which the restoration processing permit flag XRTN is set to 0 before ending this routine.

If the condition of the determination of the step 3300 holds true, that is, if the system-down processing flag XDOWN is set to 1, on the other hand, the flow of the procedure proceeds to a step 3600 to determine whether a target throttle angle TA is equal to or smaller than a restoration processing execution enabling criterion angle TAr. It should be noted that a value close to the lower limit of a usage range of the throttle angle, that is, a throttle angle representing an all but fully-closed state of the throttle valve, is used as the restoration processing execution enabling criterion angle TAr.

If the condition of the determination of the step 3600 does not hold true, that is, if the target throttle angle TA is determined greater than the restoration processing execution enabling criterion angle TAr, the flow of the procedure proceeds to a step 3700 to determine whether the restoration processing permit flag XRTN is set to 1. If the condition of the determination of the step 3700 does not hold true, that is, if the restoration processing permit flag XRTN is reset to 0, indicating that the restoration processing is not permitted, the flow of the procedure proceeds to the step 3400 at which a restoration processing permit flag XRTN is set to 0 before ending this routine.

If the condition of the determination of the step 3600 holds true, that is, if the target throttle angle TA is determined equal to or smaller than the restoration processing execution enabling criterion angle TAr or, if the condition of the determination of the step 3700 holds true, that is, if the restoration processing permit flag XRTN is set to 1 indicating that the restoration processing is permitted, on the other hand, the flow of the procedure proceeds to a step 3800 at which the restoration processing permit flag XRTN is set to 1. Then, the flow of the procedure proceeds to a next step 3900 at which the restoration processing to be described later is carried out before ending this routine.

As described above, at the step 3600 of the subroutine of the fail-safe processing, the target throttle angle TA is compared with the restoration processing execution enabling criterion angle TAr to determine whether the former is equal to or smaller than the latter. It should be noted, however, that the target throttle angle TA can also be compared with the throttle angle θt1 determined from the throttle angle sensor 16A and the throttle angle θt2 determined from the throttle angle sensor 16B to determine whether the target throttle angle TA is equal to or smaller than the throttle angles.

Figure 10:
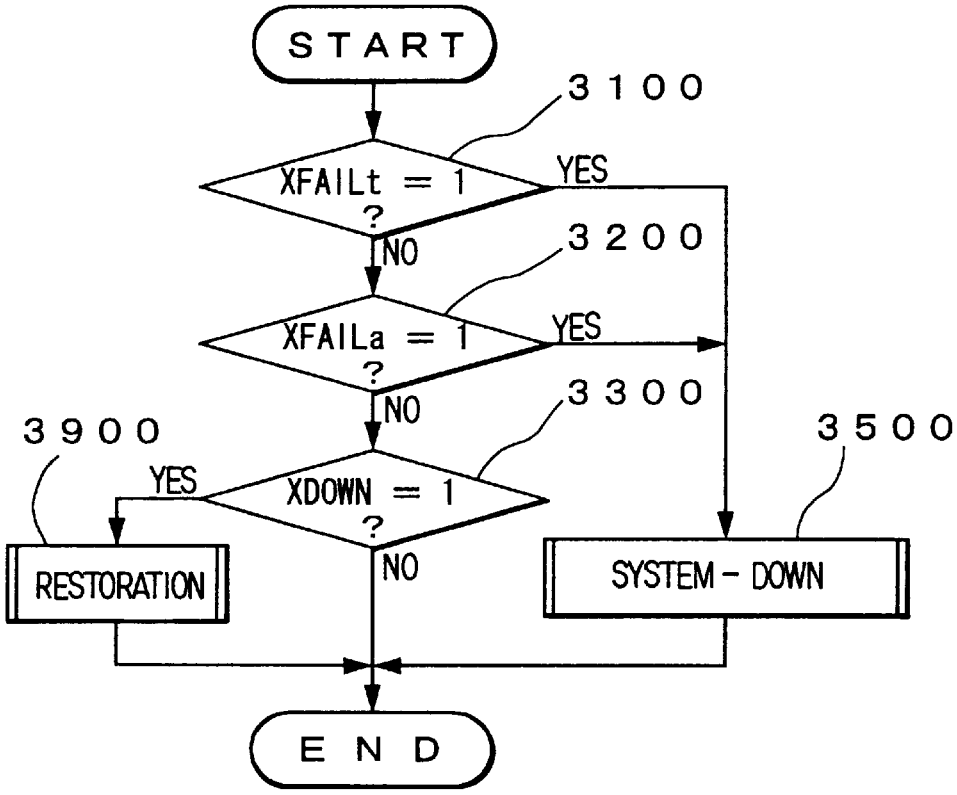
FIG. 10 is a flow diagram showing a modification of the procedure of f ail-safe processing carried out in the first embodiment.

Next, the procedure of a modification of the fail-safe processing carried out at the step 3000 of the flow diagram shown in FIG. 2 is explained by referring to a flow diagram shown in FIG. 10. It should be noted that this routine is periodically executed by the CPU 31 at intervals of 10 ms and steps of the flow diagram shown in FIG. 10 which are identical with those of the flow diagram shown in FIG. 9 are denoted by the same numbers as the later.

The flow diagram shown in FIG. 10 begins with a step 3100 to determine whether the throttle failure determination flag XFAILt is set to 1. If the condition of the determination of the step 3100 does not hold true, that is, if the throttle failure determination flag XFAILt is reset to 0, indicating that both the throttle angle sensors 16A and 16B of the dual sensor system are normal, the flow of the procedure proceeds to a step 3200 to determine whether the accelerator failure determination flag XFAILa is set to 1.

If the condition of the determination of the step 3200 does not hold true, that is, if the accelerator failure determination flag XFAILa is reset to 0, indicating that both the accelerator position sensors 22A and 22B of the dual sensor system are normal, the flow of the procedure proceeds to a step 3300 to determine whether a system-down processing flag XDOWN is set to 1. If the condition of the determination of the step 3300 does not hold true, that is, if the system-down processing flag XDOWN is reset to 0, indicating that system-down processing to be described later is not required, this routine is ended.

If the condition of the determination of the step 3100 holds true, that is, if the throttle failure determination flag XFAILt is set to 1, indicating that at least one of the throttle angle sensors 16A and 16B of the dual sensor system is abnormal or, if the condition of the determination of the step 3200 holds true, that is, if the accelerator failure determination flag XFAILa is set to 1, indicating that at least one of the accelerator position sensors 22A and 22B of the dual sensor system is abnormal, on the other hand, the flow of the procedure proceeds to a step 3500. At the step 3500, the system-down processing to be described later is carried out before ending this routine.

If the condition of the determination of the step 3300 holds true, that is, if the system-down processing flag XDOWN is set to 1, on the other hand, the flow of the procedure proceeds to a step 3900 at which the restoration processing to be described later is carried out before ending this routine. In this way, in the modification of the subroutine of the fail-safe processing, the system-down processing is carried out in the event of a sensor failure before performing the restoration processing without using the restoration processing permit flag XRTN.

Figure 11:
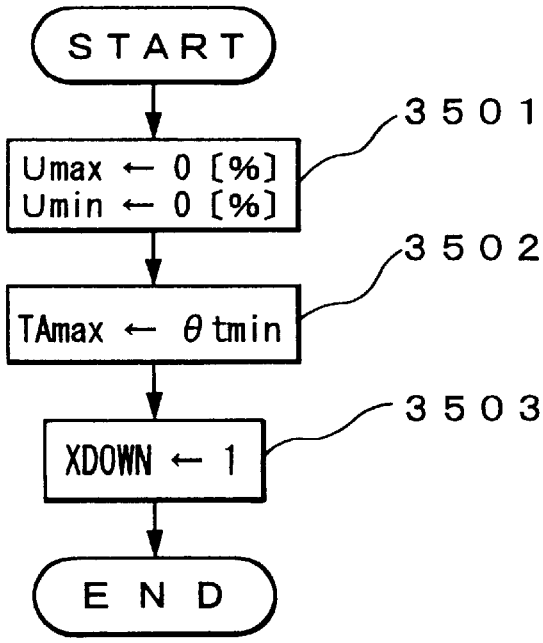
FIG. 11 is a flow diagram showing a procedure of system-down processing carried out as a step in the flow diagrams shown in FIGS. 9 and 10.

Next, the procedure of the system-down processing carried out at the step 3500 of the flow diagrams shown in FIGS. 9 and 10 is explained by referring to a flow diagram shown in FIG. 11.

The flow diagram shown in FIG. 11 begins with a step 3501 at which a motor current conduction duty ratio upper limit Umax and a motor current conduction duty ratio lower limit Umin of the actuator 20 are both set to 0 [%]. Then, the flow of the procedure proceeds to a next step 3502 at which the target throttle angle upper limit TAmax is set to the usage range lower limit opening θtmin of the throttle angle θt. Then, the flow of the procedure proceeds to a next step 3503 at which the system-down processing flag XDOWN is set to 1 before this routine is ended.

Figure 12:
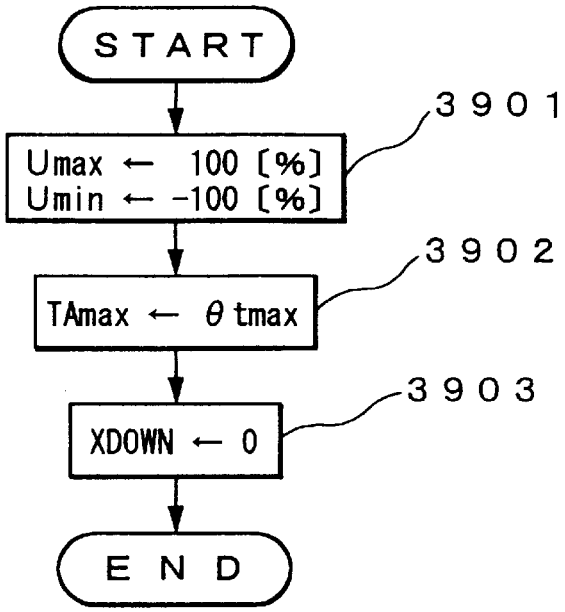
FIG. 12 is a flow diagram showing the procedure of restoration processing carried out as a step in the flow diagrams shown in FIGS. 9 and 10.

Next, the procedure of the restoration processing carried out at the step 3900 of the flow diagram is explained by referring to a flow diagram shown FIG. 12.

The flow diagram shown in FIG. 12 begins with a step 3901 at which the motor current conduction duty ratio upper limit Umax and the motor current conduction duty ratio lower limit Umin for the actuator 20 are set to 100 [%] and −100 [%], respectively. Then, the flow of the procedure proceeds to a next step 3902 at which the target throttle angle upper limit TAmax is set to the usage range upper limit opening θtmax of the throttle angle θt. Subsequently, the flow of the procedure proceeds to a next step 3903 at which the system-down processing flag XDOWN is reset to 0 before this routine is ended.

Figure 13:
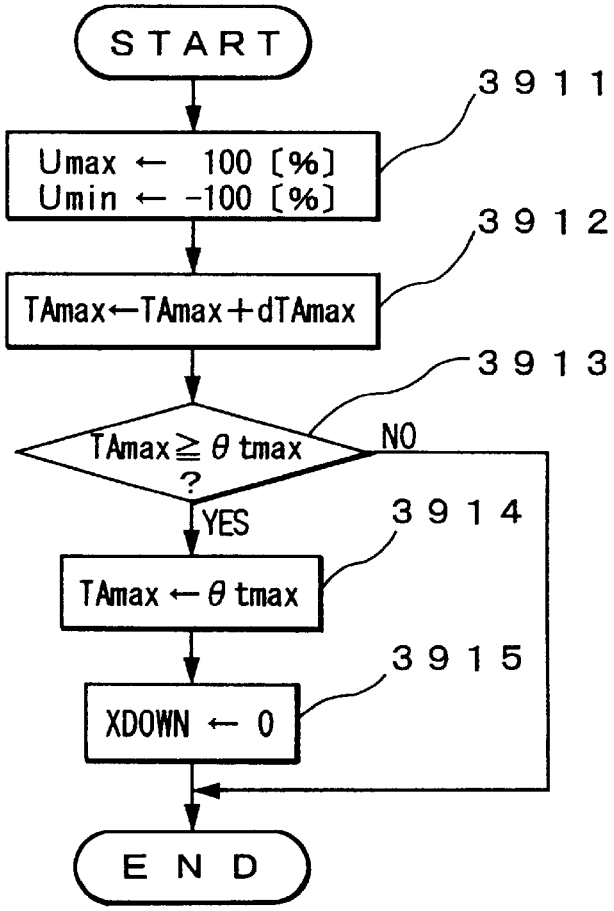
FIG. 13 is a flow diagram showing a first modification of the procedure of restoration processing carried out as a step in the flow diagram shown in FIGS. 9 and 10.

Next, the procedure of a first modification of the restoration processing carried out at the step 3900 of the flow diagrams shown in FIGS. 9 and 10 is explained by referring to a flow diagram shown FIG. 13.

The flow diagram shown in FIG. 13 begins with a step 3911 at which the motor current conduction duty ratio upper limit Umax and the motor current conduction duty ratio lower limit Umin for the actuator 20 are set to 100 [%] and −100 [%], respectively. Then, the flow of the procedure proceeds to a next step 3912 at which a target throttle angle upper limit increment dTAmax is added to the target throttle angle upper limit TAmax and a sum obtained as a result of the addition is used as the updated target throttle angle upper limit TAmax. Subsequently, the flow of the procedure proceeds to a next step 3913 to determine whether the target throttle angle upper limit TAmax is equal to or greater than the usage range upper limit opening θtmax of the throttle angle θt.

If the condition of the determination at the step 3913 holds true, that is, if the target throttle angle upper limit TAmax is determined equal to or greater than the usage range upper limit opening θtmax of the throttle angle θt, the flow of the procedure proceeds to guard processing of a step 3914 in which the target throttle angle upper limit TAmax is set to the usage range upper limit opening θtmax of the throttle angle θt. Then, the flow of the procedure proceeds to a step 3915 at which the system-down processing flag XDOWN is reset to 0. If the condition of the determination at the step 3913 does not hold true, that is, if the target throttle angle upper limit TAmax is determined smaller than the usage range upper limit opening θtmax of the throttle angle θt, on the other hand, this routine is ended without carrying out the pieces of processing of the steps 3914 and 3915.

Figure 14:
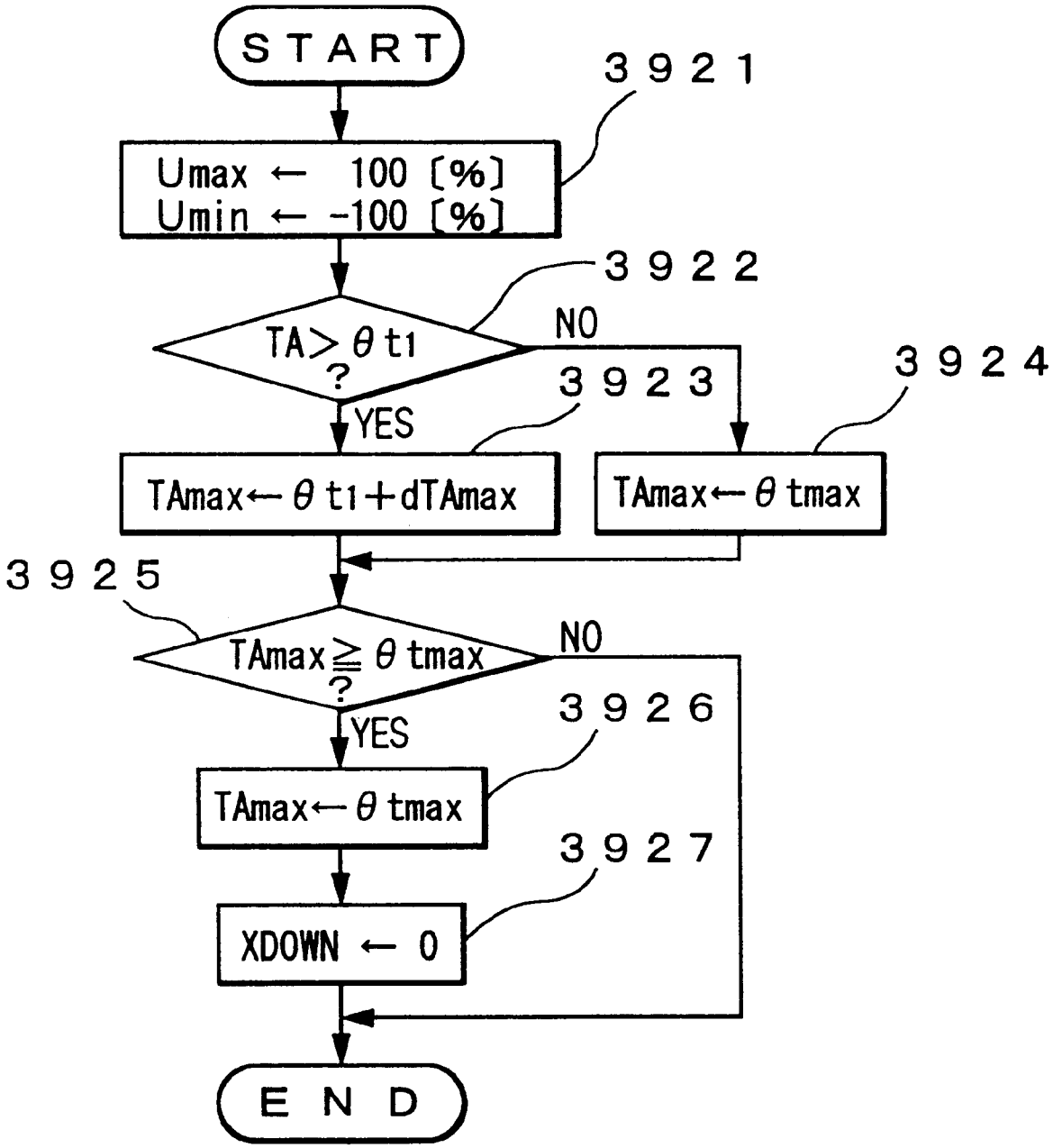
FIG. 14 is a flow diagram showing a second modification of the procedure of restoration processing carried out as a step in the flow diagram shown in FIGS. 9 and 10.

Next, the procedure of a second modification of the restoration processing carried out at the step 3900 of the flow diagrams shown in FIGS. 9 and 10 is explained by referring to a flow diagram shown FIG. 14.

The flow diagram shown in FIG. 14 begins with a step 3921 at which the motor current conduction duty ratio upper limit Umax and the motor current conduction duty ratio lower limit Umin for the actuator 20 are set to 100 [%] and −100 [%], respectively. Then, the flow of the procedure proceeds to a step 3922 to determine whether the target throttle angle TA is greater than the throttle angle θt1 acquired from the throttle angle sensor 16A at the step 1001 of the flow diagram shown in FIG. 3.

If the condition of the determination at the step 3922 holds true, that is, if the target throttle angle TA is determined greater than the throttle angle θt1, the flow of the procedure proceeds to a next step 3923 at which a target throttle angle upper limit increment dTAmax is added to the throttle angle θt1 and a sum obtained as a result of the addition is used as the updated target throttle angle upper limit TAmax. If the condition of the determination at the step 3922 does not hold true, that is, if the target throttle angle TA is determined equal to or smaller than the throttle angle θt1, on the other hand, the flow of the procedure proceeds to guard processing of a next step 3924 in which the target throttle angle upper limit TAmax is set to the usage range upper limit opening θtmax of the throttle angle θt.

Subsequently, the flow of the procedure proceeds from the step 3923 or 3924 to a next step 3925 to determine whether the target throttle angle upper limit TAmax is equal to or greater than the usage range upper limit opening θtmax of the throttle angle θt. If the condition of the determination at the step 3925 holds true, that is, if the target throttle angle upper limit TAmax is determined equal to or greater than the usage range upper limit opening θtmax of the throttle angle θt, the flow of the procedure proceeds to guard processing of a step 3926 at which the target throttle angle upper limit TAmax is set to the usage range upper limit opening θtmax of the throttle angle θt.

Then, the flow of the procedure proceeds to a step 3927 at which the system-down processing flag XDOWN is reset to 0. If the condition of the determination at the step 3925 does not hold true, that is, if the target throttle angle upper limit TAmax is determined smaller than the usage range upper limit opening θtmax of the throttle angle θt, on the other hand, this routine is ended without carrying out the pieces of processing of the steps 3926 and 3927.

Figure 15:
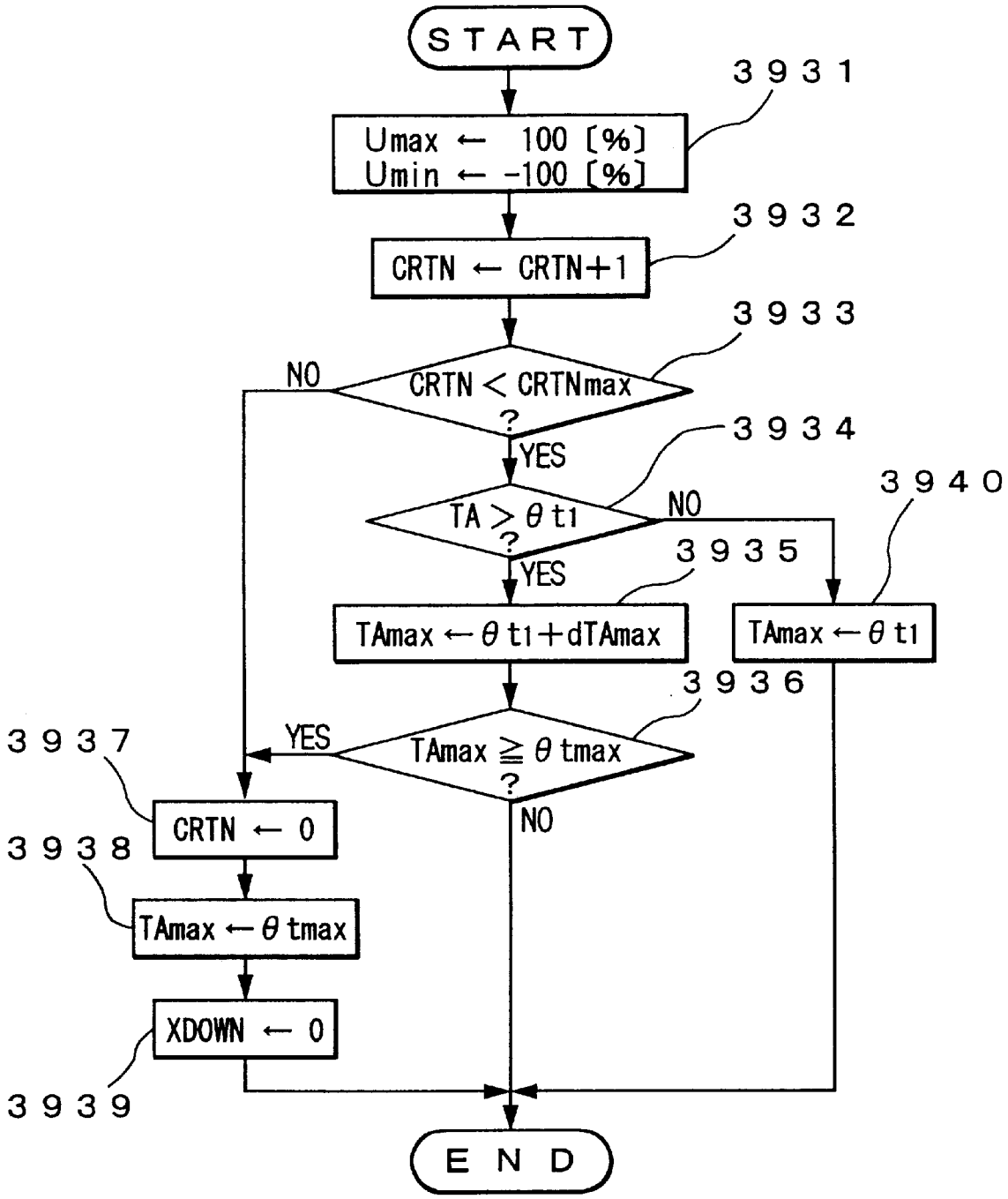
FIG. 15 is a flow diagram showing a third modification of the procedure of restoration processing carried out as a step in the flow diagram shown in FIGS. 9 and 10.

Next, the procedure of a third modification of the restoration processing carried out at the step 3900 of the flow diagrams shown in FIGS. 9 and 10 is explained by referring to a flow diagram shown FIG. 15.

The flow diagram shown in FIG. 15 begins with a step 3931 at which the motor current conduction duty ratio upper limit Umax and the motor current conduction duty ratio lower limit Umin for the actuator 20 are set to 100 [%] and −100 [%], respectively. Then, the flow of the procedure proceeds to a step 3932 at which a restoration processing lapse time counter CRTN is incremented by 1. It should be noted that the initial value of the restoration processing lapse time counter CRTN is reset to 0.

The flow of the procedure then proceeds to a next step 3933 to determine whether the restoration processing lapse time counter CRTN is smaller than a restoration processing lapse time counter maximum value CRTNmax. If the condition of the determination at the step 3933 holds true, that is, if the restoration processing lapse time counter CRTN is determined smaller than the restoration processing lapse time counter maximum value CRTNmax, the flow of the procedure proceeds to a step 3934 to determine whether the target throttle angle TA is greater than the throttle angle θt1 acquired from the throttle angle sensor 16A at the step 1001 of the flow diagram shown in FIG. 3.

If the condition of the determination at the step 3934 holds true, that is, if the target throttle angle TA is determined greater than the throttle angle θt1, the flow of the procedure proceeds to a next step 3935 at which a target throttle angle upper limit increment dTAmax is added to the throttle angle θt1 and a sum obtained as a result of the addition is used as the updated target throttle angle upper limit TAmax.

Subsequently, the flow of the procedure proceeds to a next step 3936 to determine whether the target throttle angle upper limit TAmax is equal to or greater than the usage range upper limit opening θtmax of the throttle angle θt. If the condition of the determination at the step 3936 does not hold true, that is, if the target throttle angle upper limit TAmax is determined smaller than the usage range upper limit opening θtmax of the throttle angle θt, this routine is ended.

If the condition of the determination at the step 3933 does not hold true, that is, if the restoration processing lapse time counter CRTN is determined equal to or greater than the restoration processing lapse time counter maximum value CRTNmax, or if the condition of the determination at the step 3936 holds true, that is, if the target throttle angle upper limit TAmax is determined equal to or greater than the usage range upper limit opening θtmax of the throttle angle θt, on the other hand, the flow of the procedure proceeds to a step 3937 at which the restoration processing lapse time counter CRTN is reset to 0.

Then, the flow of the procedure proceeds to guard processing of a step 3938 in which the target throttle angle upper limit TAmax is set to the usage range upper limit opening θtmax of the throttle angle θt. Then, the flow of the procedure proceeds to a step 3939 at which the system-down processing flag XDOWN is reset to 0 before ending this routine.

If the condition of the determination at the step 3934 does not hold true, that is, if the target throttle angle TA is determined equal to or smaller than the throttle angle θt1, on the other hand, the flow of the procedure proceeds to guard processing of a next step 3940 in which the target throttle angle is set to the throttle angle θt1 before ending this routine.

Figure 16:
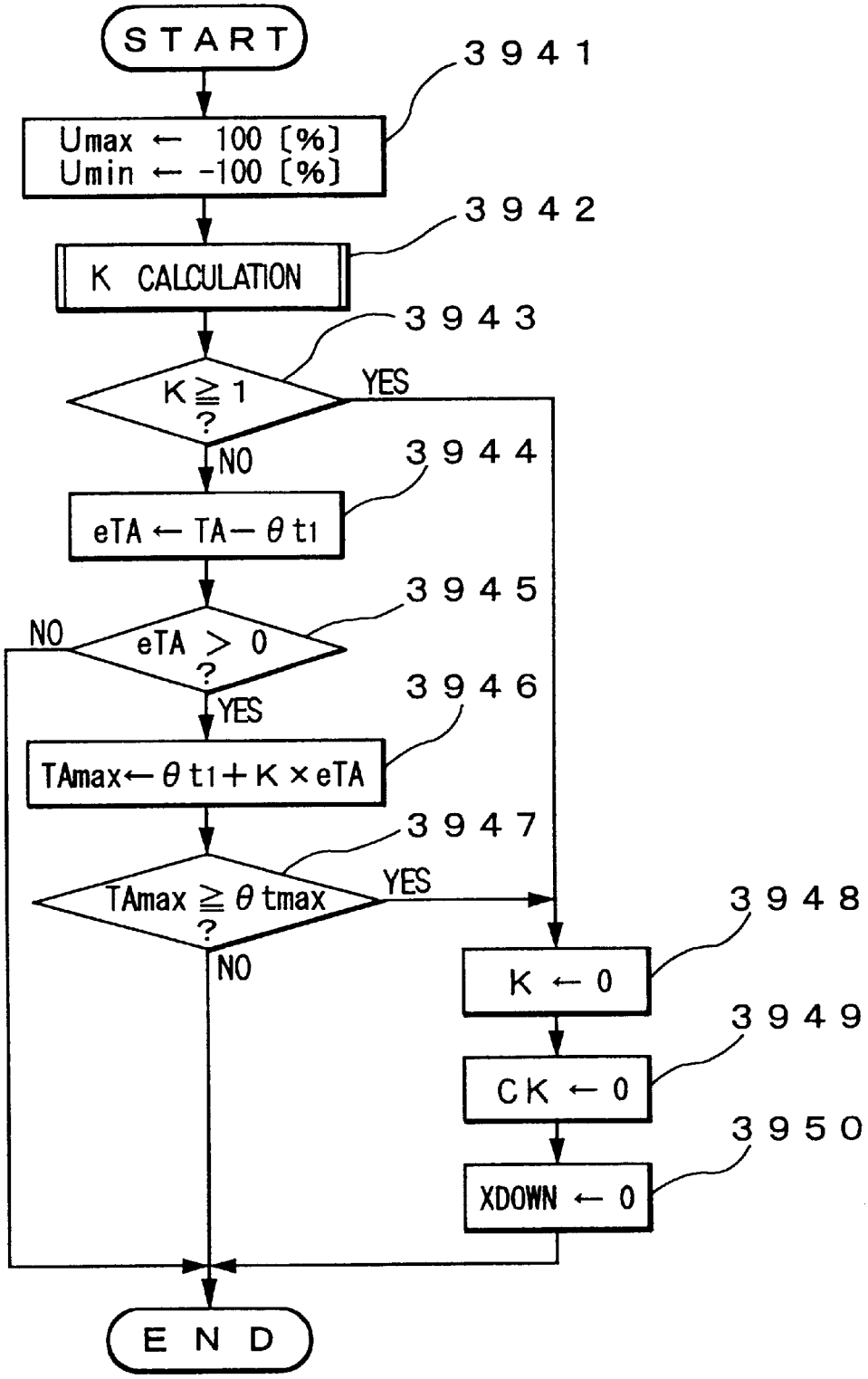
FIG. 16 is a flow diagram showing a fourth modification of the procedure of restoration processing carried out as a step in the flow diagram shown in FIGS. 9 and 10.

Next, the procedure of a fourth modification of the restoration processing carried out at the step 3900 of the flow diagrams shown in FIGS. 9 and 10 is explained by referring to a flow diagram shown FIG. 16.

The flow diagram shown in FIG. 16 begins with a step 3941 at which the motor current conduction duty ratio upper limit Umax and the motor current conduction duty ratio lower limit Umin for the actuator 20 are set to 100 [%] and −100 [%], respectively. Then, the flow of the procedure proceeds to a step 3942 to calculate a target throttle upper limit guard increment coefficient K to be described later. The flow of the procedure then proceeds to a step 3943 to determine whether the target throttle upper limit guard increment coefficient K calculated at the step 3942 is equal to or greater than 1.

If the condition of the determination at the step 3943 does not hold true, that is, if the target throttle upper limit guard increment coefficient K is determined smaller than 1, the flow of the procedure proceeds to a step 3944 at which the throttle angle θt1 acquired from the throttle angle sensor 16A at the step 1001 of the flow diagram shown in FIG. 3 is subtracted from the target throttle angle TA and a difference obtained as a result of the subtraction is used as a target throttle angle deviation eTA.

Then, the flow of the procedure proceeds to a step 3945 to determine whether the target throttle angle deviation eTA set to the step 3944 is greater than 0. If the condition of the determination at the step 3945 holds true, that is, if the target throttle angle deviation eTA is determined greater than 0, the flow of the procedure proceeds to a step 3946 at which the throttle angle θt1 is added to a product of the target throttle angle deviation eTA and the target throttle upper limit guard coefficient K, and a sum obtained as a result of the addition is used as the target throttle angle upper limit TAmax.

Then, the flow of the procedure proceeds to a step 3947 to determine whether the target throttle angle upper limit TAmax is equal to or greater than the usage range upper limit opening θtmax of the throttle angle θt. If the condition of the determination at the step 3947 does not hold true, that is, if the target throttle angle upper limit TAmax is determined smaller than the usage range upper limit opening θtmax of the throttle angle θt, this routine is ended.

If the condition of the determination at the step 3943 holds true, that is, if the target throttle upper limit guard increment coefficient K is determined equal to or greater than 1, or if the condition of the determination at the step 3947 holds true, that is, if the target throttle angle upper limit TAmax is determined equal to or greater than the usage range upper limit opening θtmax of the throttle angle θt, on the other hand, the flow of the procedure proceeds to a step 3948 at which the target throttle upper limit guard increment coefficient K is reset to 0.

Then, the flow of the procedure proceeds to a step 3949 at which a target throttle upper limit guard increment calculation counter CK is reset to 0. The flow of the procedure then proceeds to a step 3950 at which the system-down processing flag XDOWN is reset to 0 before this routine is ended. If the condition of the determination at the step 3945 does not hold true, that is, if the target throttle angle deviation eTA is determined equal to or smaller than 0, on the other hand, this routine is ended without carrying out the pieces of processing of the steps 3946 and 3947.

Next, the procedure of the processing carried out at the step 3942 of the flow diagram shown in FIG. 16 to calculate the target throttle upper limit guard increment coefficient K is explained by referring a flow diagram shown in FIG. 17 in detail as follows.

Figure 17:
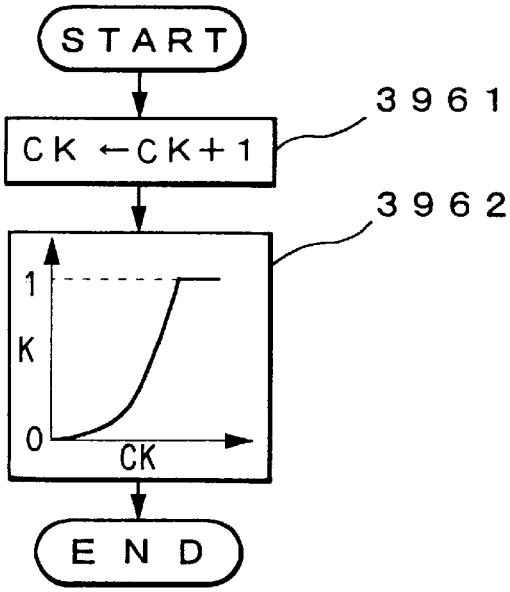
FIG. 17 is a flow diagram showing a procedure of processing carried out as a step in the flow diagram shown in FIG. 16 to calculate a target throttle upper limit guard increment coefficient.

The flow diagram shown in FIG. 17 begins with a step 3961 at which the target throttle upper limit guard increment calculation counter CK is incremented by 1. Then, the flow of the procedure proceeds to a step 3962 at which a value of the target throttle upper limit guard increment coefficient K corresponding to the target throttle upper limit guard increment calculation counter CK is determined from a map. This routine is then ended.

Figure 18:
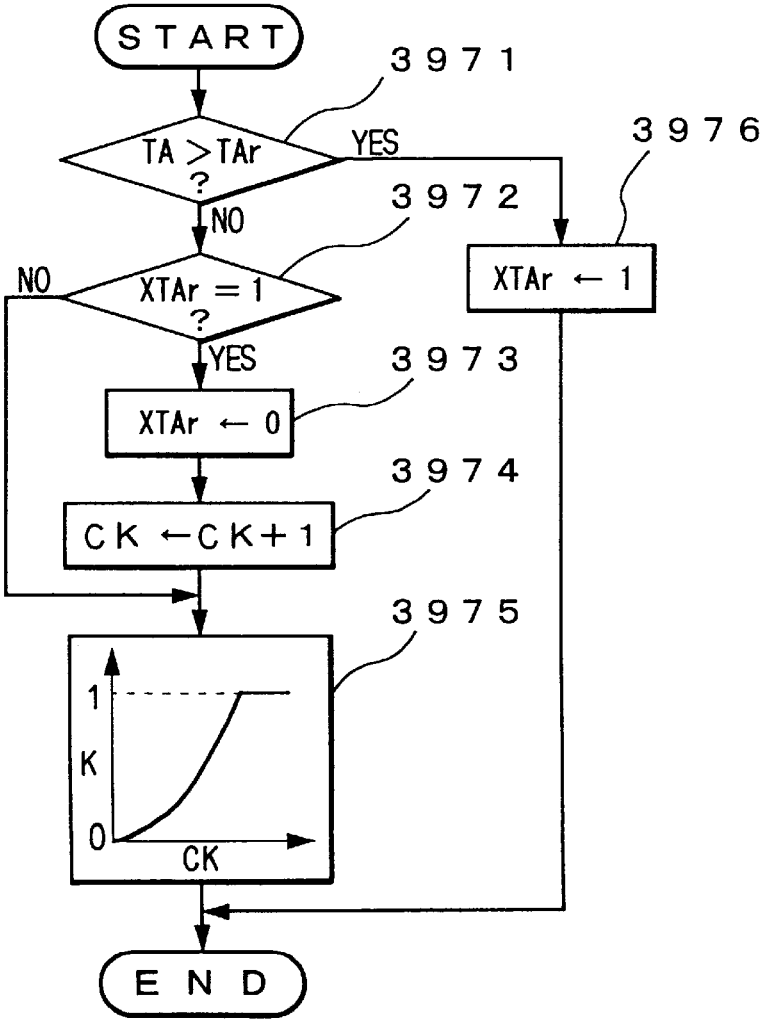
FIG. 18 is a flow diagram showing a modification of the procedure of processing carried out as a step in the flow diagram shown in FIG. 16 to calculate a target throttle upper limit guard increment coefficient.

Next, a modification of the procedure of the processing carried out at the step 3942 of the flow diagram shown in FIG. 16 to calculate the target throttle upper limit guard increment coefficient K is explained by referring a flow diagram shown in FIG. 18.

The flow diagram shown in FIG. 18 begins with a step 3971 to determine whether the target throttle angle TA is greater than a restoration processing execution enabling criterion angle TAr. If the condition of the determination at the step 3971 does not hold true, that is, if the target throttle angle TA is determined equal to or smaller than the restoration processing execution enabling criterion angle TAr, the flow of the procedure proceeds to a step 3972 to determine whether a restoration processing execution enabling flag XTAr is set to 1. If the condition of the determination at the step 3972 holds true, that is, if the restoration processing execution enabling flag XTAr is set to 1, the flow of the procedure proceeds to a step 3973 at which the restoration processing execution enabling flag XTAr is reset to 0.

Then, the flow of the procedure proceeds to a step 3974 at which the target throttle upper limit guard increment calculation counter CK is incremented by 1. If the condition of the determination at the step 3972 does not hold true, that is, if the restoration processing execution enabling flag XTAr is reset to 0, on the other hand, the flow of the procedure proceeds directly to a step 3975, skipping the steps 3973 and 3974.

Subsequently, the flow of the procedure proceeds to the step 3975 at which a value of the target throttle upper limit guard increment coefficient K corresponding to the target throttle upper limit guard increment calculation counter CK is determined from a map. This routine is then ended.

If the condition of the determination at the step 3971 holds true, that is, if the target throttle angle TA is determined greater than the restoration processing execution enabling criterion angle TAr, on the other hand, the flow of the procedure proceeds to a step 3976 at which the restoration processing execution enabling flag XTAr is set to 1. This routine is then ended.

Figure 19:
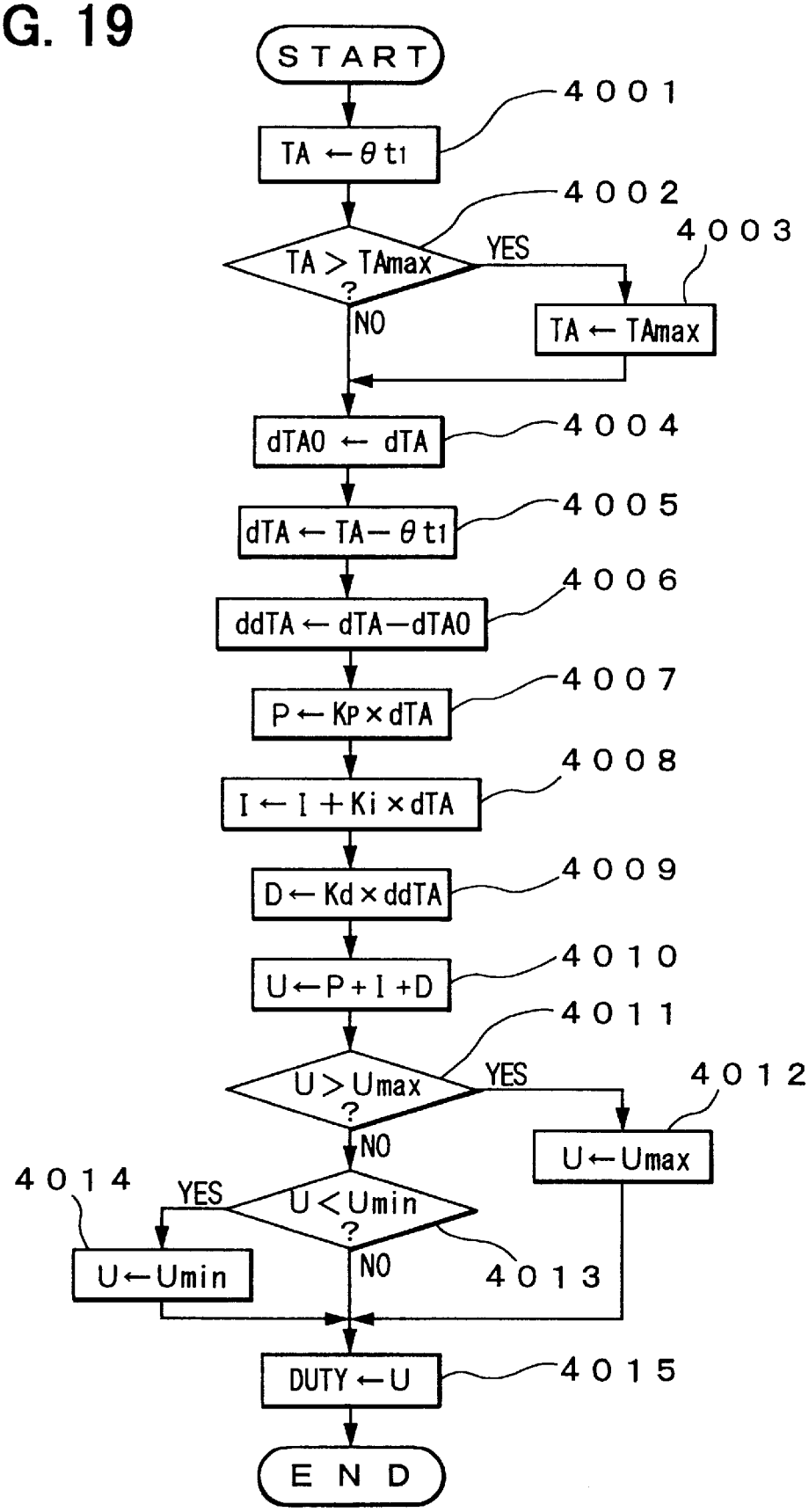
FIG. 19 is a flow diagram showing a modification of the procedure of throttle control processing carried out in the first embodiment.

Next, the procedure of the control processing carried out at the step 4000 of the flow diagram shown in FIG. 2 is explained by referring to a flow diagram shown in FIG. 19. It should be noted that the subroutine of this control processing is periodically executed by the CPU 31 at intervals of 10 ms.

The flow diagram shown in FIG. 19 begins with a step 4001 at which the target throttle angle TA is set to the throttle angle θt1 acquired from the throttle angle sensor 16A at the step 1001 of the flow diagram shown in FIG. 3. Then, the flow of the procedure proceeds to a step 4002 to determine whether the target throttle angle TA is greater than the target throttle angle upper limit TAmax. If the condition of the determination at the step 4002 holds true, that is, if the target throttle angle TA is determined greater than the target throttle angle upper limit TAmax, the flow of the procedure proceeds to a step 4003 at which the target throttle angle TA is set to the target throttle angle upper limit TAmax.

The flow of the procedure proceeds to a step 4004 after completing the processing of the step 4003 or if the condition of the determination at the step 4002 doe not hold true, that is, if the target throttle angle TA is determined equal to or smaller than the target throttle angle upper limit TAmax. At the step 4004, an immediately preceding target throttle angle deviation dTAO is set to a target throttle angle deviation dTA. The initial value of the target throttle angle deviation dTAO is 0.

Then, the flow of the procedure proceeds to a step 4005 at which the target throttle angle deviation dTA is set to a difference obtained as a result of subtracting the throttle angle θt1 from the target throttle angle TA. The flow of the procedure then proceeds to a step 4006 at which a change in target throttle angle deviation ddTA is set to a difference obtained as a result of subtracting the immediately preceding target throttle angle deviation dTAO from the target throttle angle deviation dTA.

Then, the flow of the procedure proceeds to a step 4007 at which a proportional control variable P is set to a product obtained as a result of multiplying the target throttle angle deviation dTA set to the step 4005 by a proportional gain Kp. Subsequently, the flow of the procedure proceeds to a step 4008 at which a product of the target throttle angle deviation dTA set to the step 4005 and an integral gain Ki is added to an integral control variable I and a sum obtained as a result of the addition is used as an updated integral control variable I.

The flow of the procedure then proceeds to a step 4009 at which a differential control variable D is set to a product obtained as a result of multiplying the change in target throttle angle deviation ddTA set to the step 4006 by a differential gain Kd. Then, the flow of the procedure proceeds to a step 4010 at which a motor control variable U is set to the sum of the proportional control variable P, the integral control variable I and the differential control variable D.

Subsequently, the flow of the procedure proceeds to a step 4011 to determine whether the motor control variable U determined at the step 4010 is greater than a motor current conduction duty ratio upper limit Umax. If the condition of the determination at the step 4011 holds true, that is, if the motor control variable U is determined greater than the motor current conduction duty ratio upper limit Umax, the flow of the procedure proceeds to guard processing of a step 4012 in which the motor control variable U is set to the motor current conduction duty ratio upper limit Umax.

If the condition of the determination at the step 4011 does not hold true, that is, if the motor control variable U is determined equal to or smaller than the motor current conduction duty ratio upper limit Umax, on the other hand, the flow of the procedure proceeds to a step 4013 to determine whether the motor control variable U is greater than a motor current conduction duty ratio lower limit Umin. If the condition of the determination at the step 4013 holds true, that is, if the motor control variable U is determined greater than the motor current conduction duty ratio lower limit Umin, the flow of the procedure proceeds to guard processing of a step 4014 in which the motor control variable U is set to the motor current conduction duty ratio lower limit Umin.

The flow of the procedure then continues to a step 4015, upon completion of the processing at the step 4012 or 4014, or if the condition of the determination at the step 4013 does not hold true, that is, if the motor control variable U is determined equal to or smaller than the motor current conduction duty ratio lower limit Umin. At the step 4015, a motor current conduction duty ratio DUTY is set to the motor control variable U.

As described above, when a failure is detected in one or more of elements composing the throttle control apparatus of the internal combustion engine implemented by the embodiment such as the accelerator position sensors 22A and 22B, and the throttle angle sensors 16A and 16B, the electric conduction to the actuator 20 is cut off. By setting the target throttle angle upper limit TAmax of the target throttle angle TA at the usage lower limit opening θtmin of the usage range of the throttle angle θt1, the throttle angle can be set below a predetermined value. Then, the target throttle angle TA is returned to a normal value with a grasped restoration timing of detection of the failure in one or more the elements composing the throttle control apparatus such as the accelerator position sensors 22A and 22B, and the throttle angle sensors 16A and 16B is restored to a normal state. As a result, it is possible to prevent the vehicle from performing an improper operation at the time a failure detected in one or more of the elements composing the throttle control apparatus such as the accelerator position sensors 22A and 22B, and the throttle angle sensors 16A and 16B is restored to a normal state.

In addition, when the target throttle angle TA becomes equal to or smaller than the restoration processing execution enabling criterion angle TAr set as a predetermined throttle angle or the throttle angle θt1, the target throttle angle upper limit TAmax of the target throttle angle TA is restored to a value used at a normal time. In this way, since restoration processing is not permitted unless the target throttle angle TA once becomes equal to or smaller than the restoration processing execution enabling criterion angle TAr set as a predetermined throttle angle or the throttle angle θt1, the throttle valve 12 can be prevented from opening abruptly in response to an operation carried out by the driver on the accelerator pedal 21 at the time one or more of the elements composing the throttle control apparatus such as the accelerator position sensors 22A and 22B, and the throttle angle sensors 16A and 16B are restored to a normal state after a failure has been once detected therein.

Furthermore, the target throttle angle upper limit TAmax of the target throttle angle TA increases gradually. In this way, since the target throttle angle upper limit TAmax of the target throttle angle TA gradually increases from the usage lower limit opening θtmin of a usage range of the throttle angle θt1, the throttle valve 12 can be prevented from opening abruptly in response to an operation carried out by the driver on the accelerator pedal 21 at the time one or more of the elements composing the throttle control apparatus such as the accelerator position sensors 22A and 22B, and the throttle angle sensors 16A and 16B are restored to a normal state after a failure has been once detected therein.

Moreover, the opening speed of the throttle valve 12 is restrained only during a period in which the target throttle angle TA is greater than the throttle angle θt1 after the start of the restoration control. In this way, since the opening speed of the throttle valve 12 is limited by the target throttle angle upper limit increment dTAmax only during a period in which the target throttle angle TA is greater than the throttle angle θt1 after the start of the restoration control, the throttle valve 12 can be prevented from opening abruptly in response to an operation carried out by the driver on the accelerator pedal 21 at the time one or more of the elements composing the throttle control apparatus such as the accelerator position sensors 22A and 22B, and the throttle angle sensors 16A and 16B are restored to a normal state after a failure has been once detected therein.

In addition, the opening speed of the throttle valve 12 is restrained only during a predetermined period till the restoration processing lapse time counter CRTN exceeds the restoration processing lapse time counter CRTNmax after the start of the restoration control. In this way, since the opening speed of the throttle valve 12 is limited only during a period in which the target throttle angle upper limit TAmax of the target throttle angle TA is once set to the usage lower limit opening θtmin of a usage range of the throttle angle θt1 and then the restoration processing lapse time counter CRTN exceeds the restoration processing lapse time counter CRTNmax after the start of the restoration control, the throttle valve 12 can be prevented from opening abruptly in response to an operation carried out by the driver on the accelerator pedal 21 at the time one or more of the elements composing the throttle control apparatus such as the accelerator position sensors 22A and 22B, and the throttle angle sensors 16A and 16B are restored to a normal state after a failure has been once detected therein.

Furthermore, the limitation on the opening speed of throttle valve 12 is relieved gradually. In this way, since the target throttle angle upper limit TAmax of the target throttle angle TA is once set to the usage lower limit opening θtmin of a usage range of the throttle angle θt1 and then the limitation on the opening speed of throttle valve 12 is relieved gradually on the basis of the target throttle angle deviation eTA and the target throttle upper limit guard increment coefficient K so that the opening speed increases, the throttle valve 12 can be prevented from opening abruptly in response to an operation carried out by the driver on the accelerator pedal 21 at the time one or more of the elements composing the throttle control apparatus such as the accelerator position sensors 22A and 22B, and the throttle angle sensors 16A and 16B are restored to a normal state after a failure has been once detected therein.

Second Embodiment

The throttle control apparatus according to a second embodiment is directed to an improved limp-home operation effected upon detection of a failure. The second embodiment is constructed as shown in FIG. 20.

Figure 20:
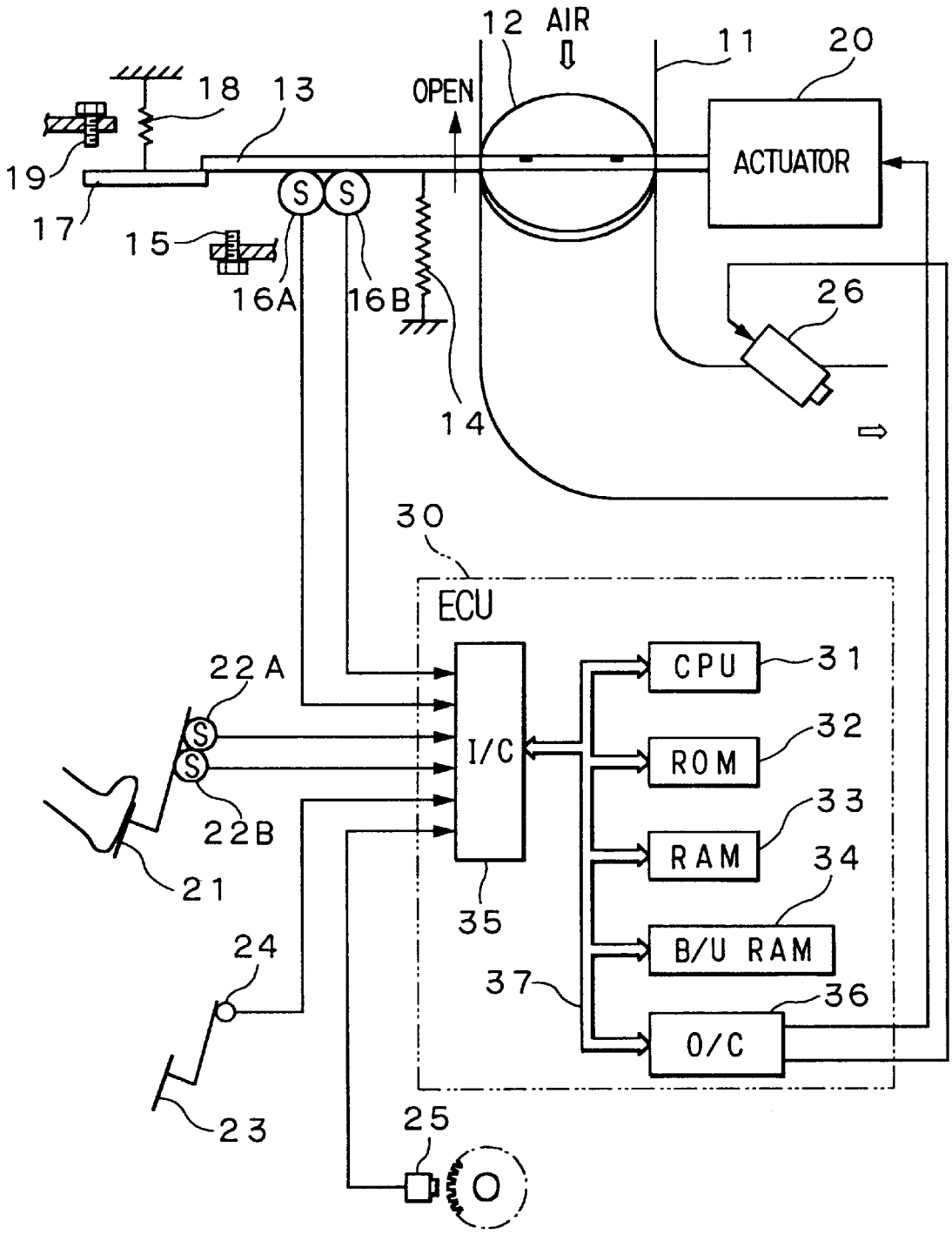
FIG. 20 is a schematic diagram showing a throttle control apparatus for an internal combustion engine implemented in a second embodiment of the present invention.

In FIG. 20, in addition to the first embodiment, the ECU 30 is connected to a brake switch 24 coupled with a brake pedal 23. The brake switch 24 is turned on from a turned-off state by foot pressure applied to the brake pedal 23. An engine speed sensor 25 for detecting a crank angle is provided on a crankshaft (not shown) of the internal combustion engine. An injector (or a fuel injection valve) 26 for supplying or injecting fuel to the internal combustion engine is provided on the downstream side of the throttle valve 12 on the intake pipe 11.

Figure 21:
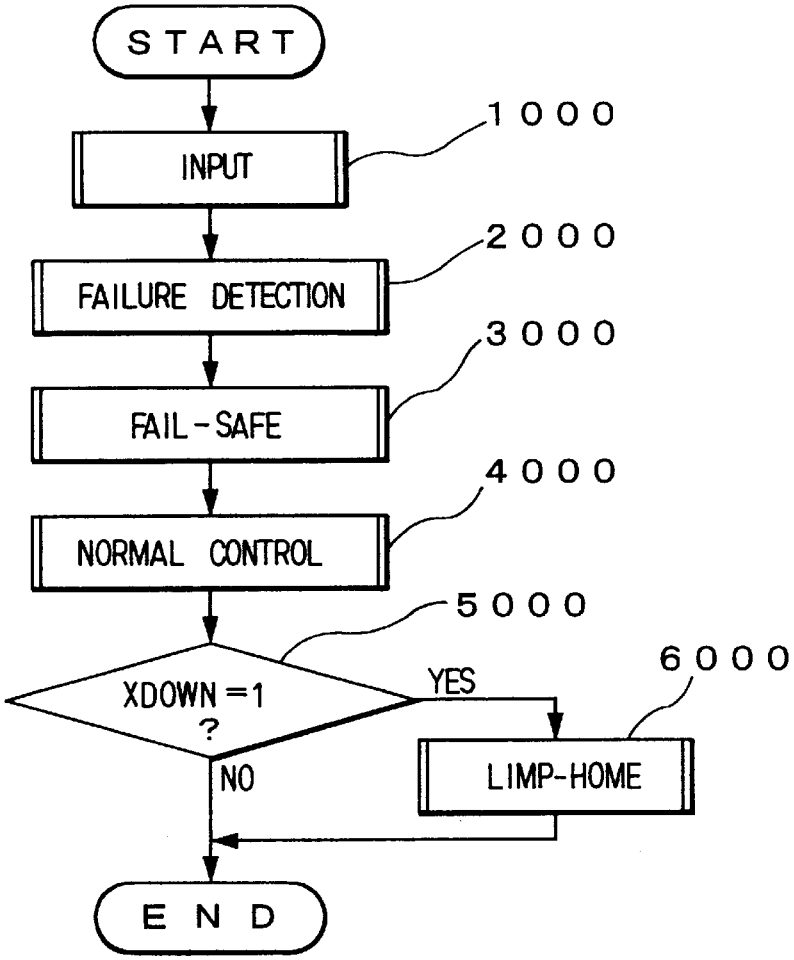
FIG. 21 is a flow diagram showing a base routine executed by a CPU employed in an ECU used in the second embodiment.

The ECU 30, particularly the CPU 31, in the second embodiment is programmed to execute a base routine shown in FIG. 21. It should be noted that this base routine is periodically executed by the CPU 31 at intervals of 10 ms after power is supplied by turning on an ignition switch which is shown in none of the figures.

As shown in FIG. 21, the flow diagram begins with the step 1000 at which input processing is carried out to fetch input signals generated by a variety of sensors. Then, the flow of the base routine proceeds to the step 2000 at which failure detection processing is carried out to detect the throttle failure, the accelerator failure and the throttle control failure. Subsequently, the flow of the base routine proceeds to the step 3000 at which fail-safe processing is carried out to execute a fail-safe operation in the event of the throttle failure, the accelerator failure and the throttle control failure. The flow of the base routine then proceeds to the step 4000 at which normal control processing is carried out to calculate the control variable for the actuator 20 from the input signals received from the sensors.

Then, the flow of the base routine proceeds to a step 5000 to determine whether the system-down processing flag XDOWN is set to 1. If the condition of the determination at the step 5000 does not hold true, that is, if the system-down processing flag XDOWN is reset to 0, indicating that the system is normally operating, control of the actuator 20 based on the control variable calculated at the step 4000 is executed and the base routine is ended. If the condition of the determination at the step 5000 holds true, that is, if the system-down processing flag XDOWN is set to 1, indicating that the system is abnormal, on the other hand, the flow of the base routine proceeds to a step 6000 at which limp-home operation processing is carried out to execute limp-home control of the internal combustion engine and then the base routine is ended.

Next, the pieces of processing carried out at the steps of the flow diagram representing the base routine are explained in detail.

Figure 22:
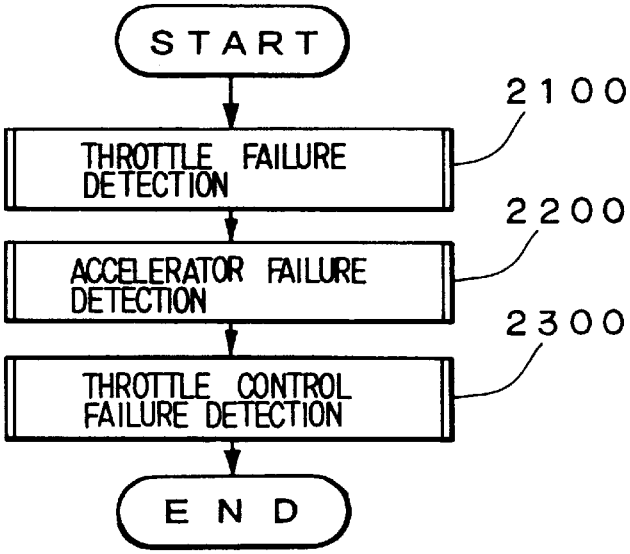
FIG. 22 is a flow diagram showing a procedure of processing to detect a failure carried out in the second embodiment.

First of all, the procedure of the processing to detect a failure carried out at the step 2000 of the flow diagram shown in FIG. 21 is explained by referring to a flow diagram shown in FIG. 22. It should be noted that the subroutine of this processing to detect a failure is periodically executed by the CPU 31 at intervals of 10 ms.

As shown in FIG. 22, the flow diagram begins with the step 2100 at which processing to detect a failure occurring in the throttle is carried out. The flow of the subroutine then proceeds to the step 2200 at which processing to detect a failure occurring in the accelerator is carried out. In the second embodiment, the flow of the subroutine further proceeds to a step 2300 at which processing to detect a failure in occurring in throttle control to be described later is carried out. Finally, the subroutine is ended.

Figure 23:
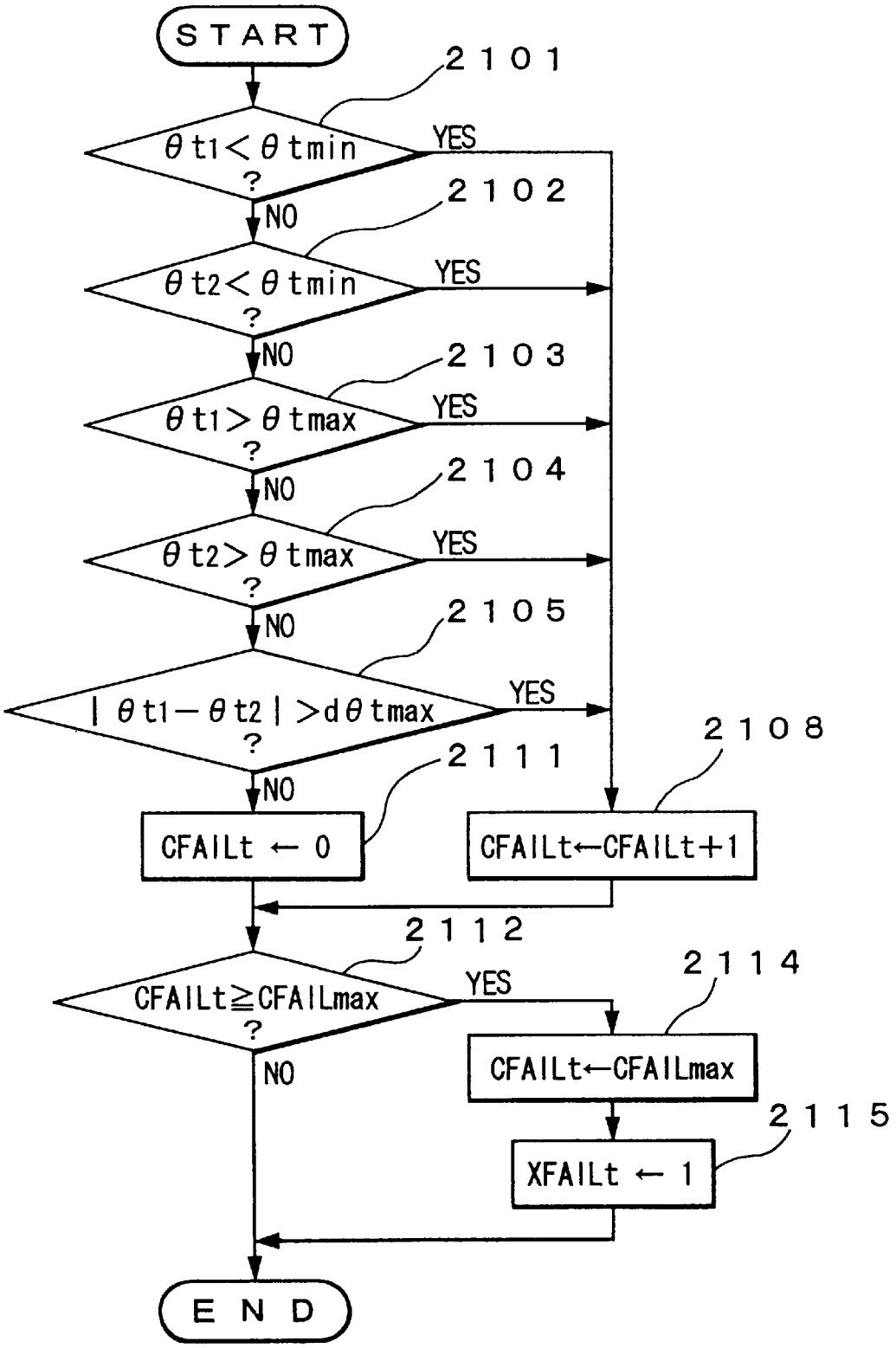
FIG. 23 is a flow diagram showing a procedure of processing to detect a throttle failure carried out at a step in the flow diagram shown in FIG. 22.

Next, the procedure of the processing to detect the throttle failure carried out at the step 2100 of the flow diagram shown in FIG. 22 is explained in detail by referring to a flow diagram shown in FIG. 23. The steps 2101 to 2105 are performed in the same manner as in the first embodiment (FIG. 7).

If the condition of determination at the step 2105 of the flow diagram does not hold true, that is, if the absolute value of the deviation between the throttle angle θt1 and the throttle angle θt2 is equal to or smaller than a throttle angle deviation failure criterion value d θtmax, the flow of the procedure proceeds to the step 2111 at which the throttle failure determination counter CFAILt is cleared to 0. If the result of the determination at any one of steps 2101 to 2105 is YES, indicating that the output state of at least one of the throttle angle sensors 16A and 16B of the dual sensor system is abnormal, on the other hand, the flow of the procedure proceeds to the step 2108 at which the throttle failure determination counter CFAILt is incremented by 1.

The flow of the procedure then proceeds from the step 2111 or 2108 to the step 2112 to determine whether the throttle failure determination counter CFAILt is equal to or greater than the failure determination counter maximum CFAILmax. If the condition of the determination at the step 2112 does not hold true, that is, if the throttle failure determination counter CFAILt is smaller than the failure determination counter maximum CFAILmax, a throttle failure is not determined to exist yet with an effect of noise and the like taken into consideration. In this case, this routine is just terminated.

If the condition of the determination at the step 2112 holds true, that is, if the throttle failure determination counter CFAILt is equal to or greater than the failure determination counter maximum CFAILmax, on the other hand, the flow of the procedure proceeds to the step 2114 at which the throttle failure determination counter CFAILt is set to the failure determination counter maximum CFAILmax. Then, the flow of the procedure proceeds to the step 2115 at which the throttle failure determination flag XFAILt is set to 1 to indicate that a throttle failure has been determined to exist. Then, this routine is terminated.

Figure 24:
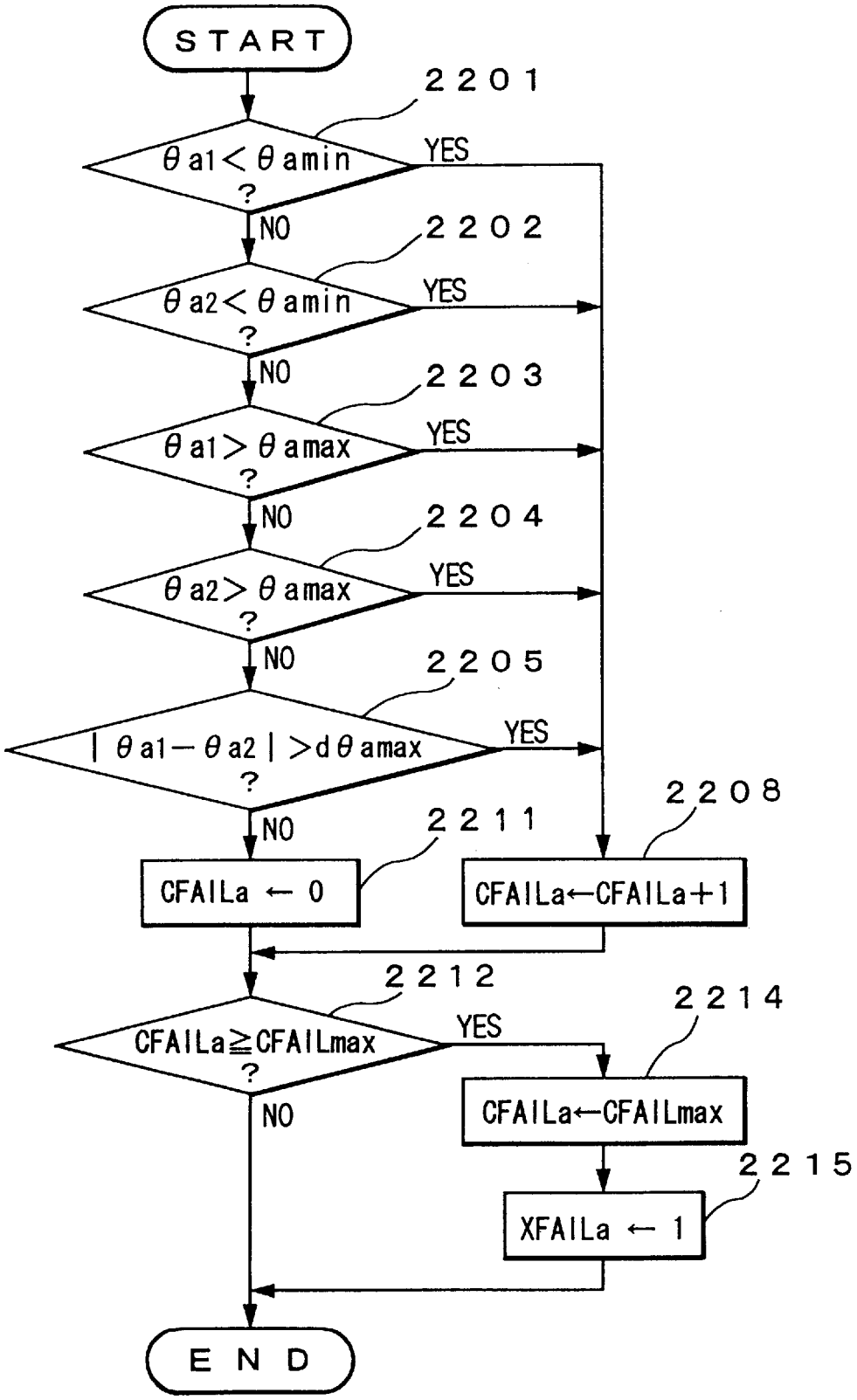
FIG. 24 is a flow diagram showing a procedure of processing to detect an accelerator failure carried out at a step in the flow diagram shown in FIG. 22.

Next, the procedure of the processing to detect an accelerator failure carried out at the step 2200 of the flow diagram shown in FIG. 22 is explained in detail by referring to a flow diagram shown in FIG. 24. The steps 2201 to 2205 are performed in the same manner as in the first embodiment (FIG. 8).

If the condition of determination at the step 2205 of the flow diagram shown in FIG. 24 does not hold true, that is, if the absolute value of a deviation between an accelerator position θa1 and an accelerator position θa2 is equal to or smaller than the accelerator position deviation failure criterion value d θamax, the flow of the procedure proceeds to the step 2211 at which the accelerator failure determination counter CFAILa is cleared to 0. If the result of the determinations at any one of steps 2201 to 2205 is YES, indicating that the output state of at least one of the accelerator position sensors 22A and 22B of the other dual sensor system is abnormal, on the other hand, the flow of the procedure proceeds to the step 2208 at which the accelerator failure determination counter CFAILa is incremented by 1.

The flow of the procedure then proceeds from the step 2211 or 2208 to the step 2212 to determine whether the accelerator failure determination counter CFAILa is equal to or greater than the failure determination counter maximum CFAILmax. If the condition of the determination at the step 2212 does not hold true, that is, if the accelerator failure determination counter CFAILa is smaller than the failure determination counter maximum CFAILmax, an accelerator failure is not determined to exist yet with an effect of noise and the like taken into consideration. In this case, this routine is just terminated.

If the condition of the determination at the step 2212 holds true, that is, if the accelerator failure determination counter CFAILa is equal to or greater than the failure determination counter maximum CFAILmax, on the other hand, the flow of the procedure proceeds to the step 2214 at which the accelerator failure determination counter CFAILa is set to the failure determination counter maximum CFAILmax. Then, the flow of the procedure proceeds to the step 2215 at which the accelerator failure determination flag XFAILa is set to 1 to indicate that an accelerator failure has been determined to exist. Then, this routine is terminated.

Figure 25:
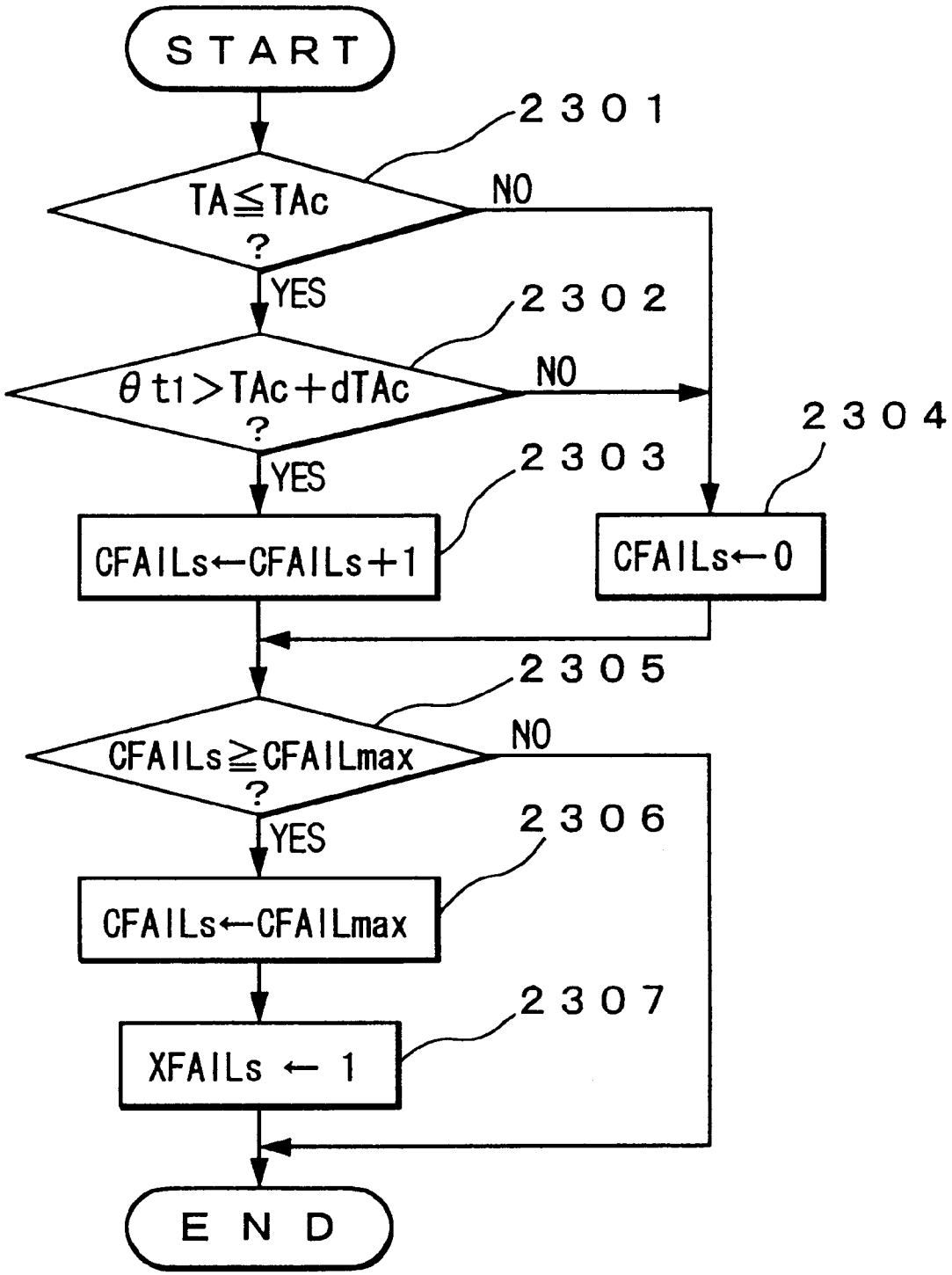
FIG. 25 is a flow diagram showing a procedure of processing to detect a throttle control failure carried out at a step in the flow diagram shown in FIG. 22.

Next, the procedure of the processing to detect the throttle control failure carried out at the step 2300 of the flow diagram shown in FIG. 22 is explained in detail by referring to a flow diagram shown in FIG. 25.

As shown in FIG. 25, the flow diagram begins with a step 2301 to determine whether the target throttle angle TA is equal to or smaller than a target closed throttle angle criterion value TAc. If the condition of the determination at the step 2301 holds true, that is, if the target throttle angle TA is equal to or smaller than the target closed throttle angle criterion value TAc, the flow of the procedure proceeds to a step 2302 to determine whether the throttle angle θt1 is greater than a sum obtained as a result of adding the target closed throttle angle criterion value TAc to a target closed throttle angle criterion value deviation dTAc (TAc+dTAc).

If the condition of the determination at the step 2302 holds true, that is, if the throttle angle θt1 is greater than a sum obtained as a result of adding the target closed throttle angle criterion value TAc to the target closed throttle angle criterion value deviation dTAc (TAc+dTAc), the flow of the procedure proceeds to a step 2303 at which a throttle control failure determination counter CFAILs is incremented by 1.

If the condition of the determination at the step 2301 does not hold true, that is, if the target throttle angle TA is greater than the target closed throttle angle criterion value TAc, or if the condition of the determination at the step 2302 does not hold true, that is, if the throttle angle θt1 is equal to or smaller than a sum obtained as a result of adding the target closed throttle angle criterion value TAc to the target closed throttle angle criterion value deviation dTAc (TAc+dTAc), on the other hand, the flow of the procedure proceeds to a step 2304 at which the throttle control failure determination counter CFAILs is cleared to 0.

The flow of the procedure then proceeds from the step 2303 or 2304 to a step 2305 to determine whether the throttle control failure determination counter CFAILs is equal to or greater than the failure determination counter maximum CFAILmax. If condition of the determination at the step 2305 holds true, that is, if the throttle control failure determination counter CFAILs is equal to or greater than the failure determination counter maximum CFAILmax, the flow of the procedure proceeds to a step 2306 at which the throttle control failure determination counter CFAILs is set to the failure determination counter maximum CFAILmax. Then, the flow of the procedure proceeds to a step 2307 at which a throttle control failure determination flag XFAILs is set to 1 to indicate that a throttle control failure has been determined to exist. This routine is then ended.

If condition of the determination at the step 2305 does not hold true, that is, if the throttle control failure determination counter CFAILs is smaller than the failure determination counter maximum CFAILmax, on the other hand, a throttle control failure is not determined to exist yet with an effect of noise and the like taken into consideration. In this case, this routine is just terminated.

Figure 26:
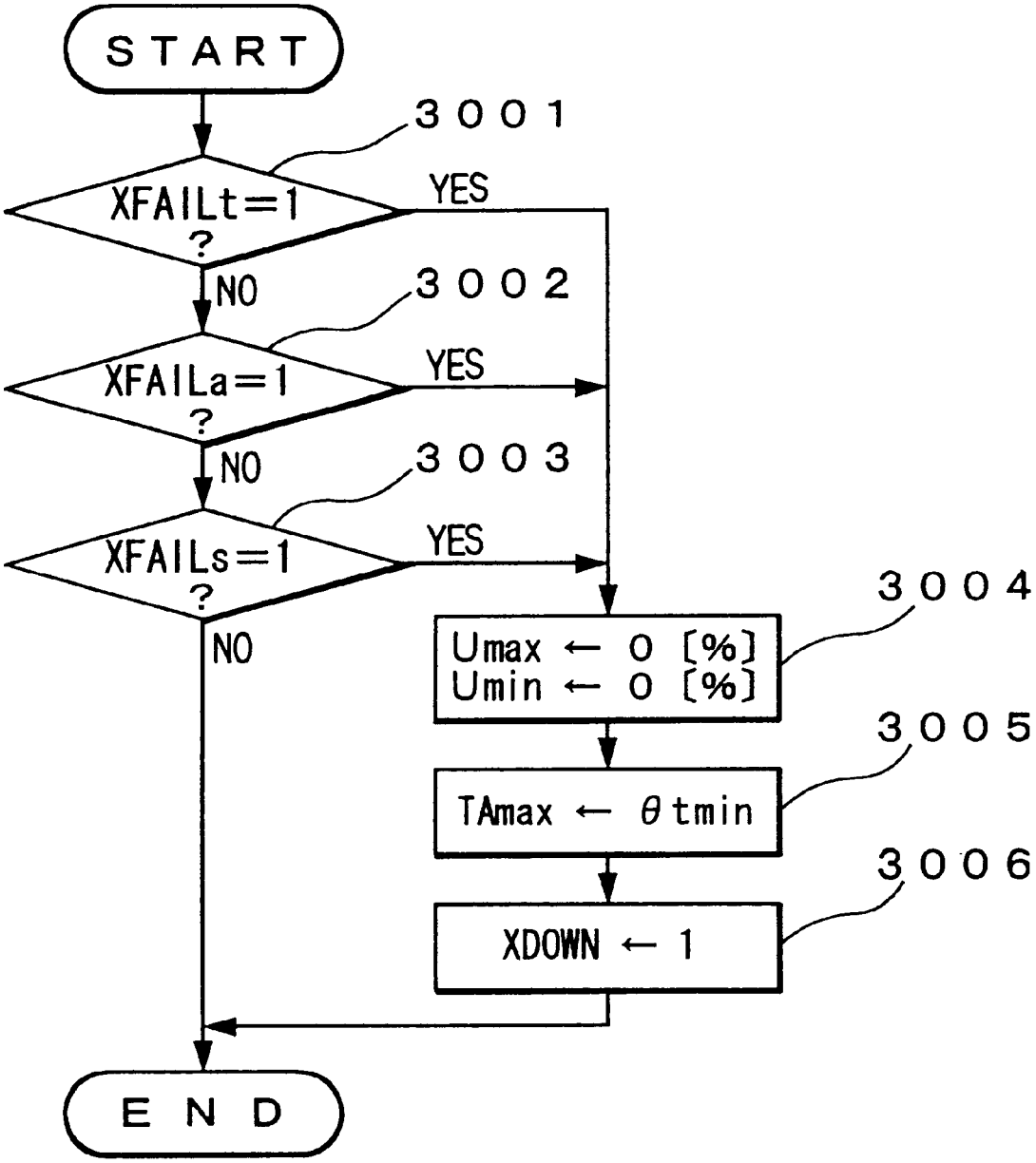
FIG. 26 is a flow diagram showing a procedure of fail-safe processing carried out in the second embodiment.

Next, the procedure of the fail-safe processing carried out at the step 3000 of the flow diagram shown in FIG. 21 is explained by referring to a flow diagram shown in FIG. 26. It should be noted that the subroutine of the fail-safe processing is periodically executed by the CPU 31 at intervals of 10 ms.

The flow diagram shown in FIG. 26 begins with a step 3001 to determine whether the throttle failure determination flag XFAILt is set to 1. If the condition of the determination of the step 3001 does not hold true, that is, if the throttle failure determination flag XFAILt is reset to 0, indicating that both the throttle angle sensors 16A and 16B of the dual sensor system are normal, the flow of the procedure proceeds to a step 3002 to determine whether the accelerator failure determination flag XFAILa is set to 1. If the condition of the determination of the step 3002 does not hold true, that is, if the accelerator failure determination flag XFAILa is reset to 0, indicating that both the accelerator position sensors 22A and 22B of the other dual sensor system are normal, the flow of the procedure proceeds to a step 3003 to determine whether the throttle control failure determination flag XFAILs is set to 1. If the condition of the determination of the step 3003 does not hold true, that is, if the throttle control failure determination flag XFAILs is reset to 0, indicating that throttle control is normal, this routine is just ended.

On the other hand, the flow of the procedure proceeds to a step 3004, if the condition of the determination of the step 3001 holds true, that is, if the throttle failure determination flag XFAILt is set to 1, indicating that at least one of the throttle angle sensors 16A and 16B of the dual sensor system is abnormal, if the condition of the determination of the step 3002 holds true, that is., if the accelerator failure determination flag XFAILa is set to 1, indicating that at least one of the accelerator position sensors 22A and 22B of the other dual sensor system is abnormal, or if the condition of the determination of the step 3003 holds true, that is, if the throttle control failure determination flag XFAILs is set to 1, indicating that throttle control is abnormal. At the step 3004, the motor current conduction duty ratio upper limit Umax and the motor current conduction duty ratio lower limit Umin of the actuator 20 are both set to 0 [%].

Then, the flow of the procedure proceeds to a next step 3005 at which the target throttle angle upper limit TAmax is set to the usage range lower limit opening θtmin of the throttle angle θt. Then, the flow of the procedure proceeds to a next step 3006 at which the system-down processing flag XDOWN is set to 1 before this routine is ended.

Figure 27:
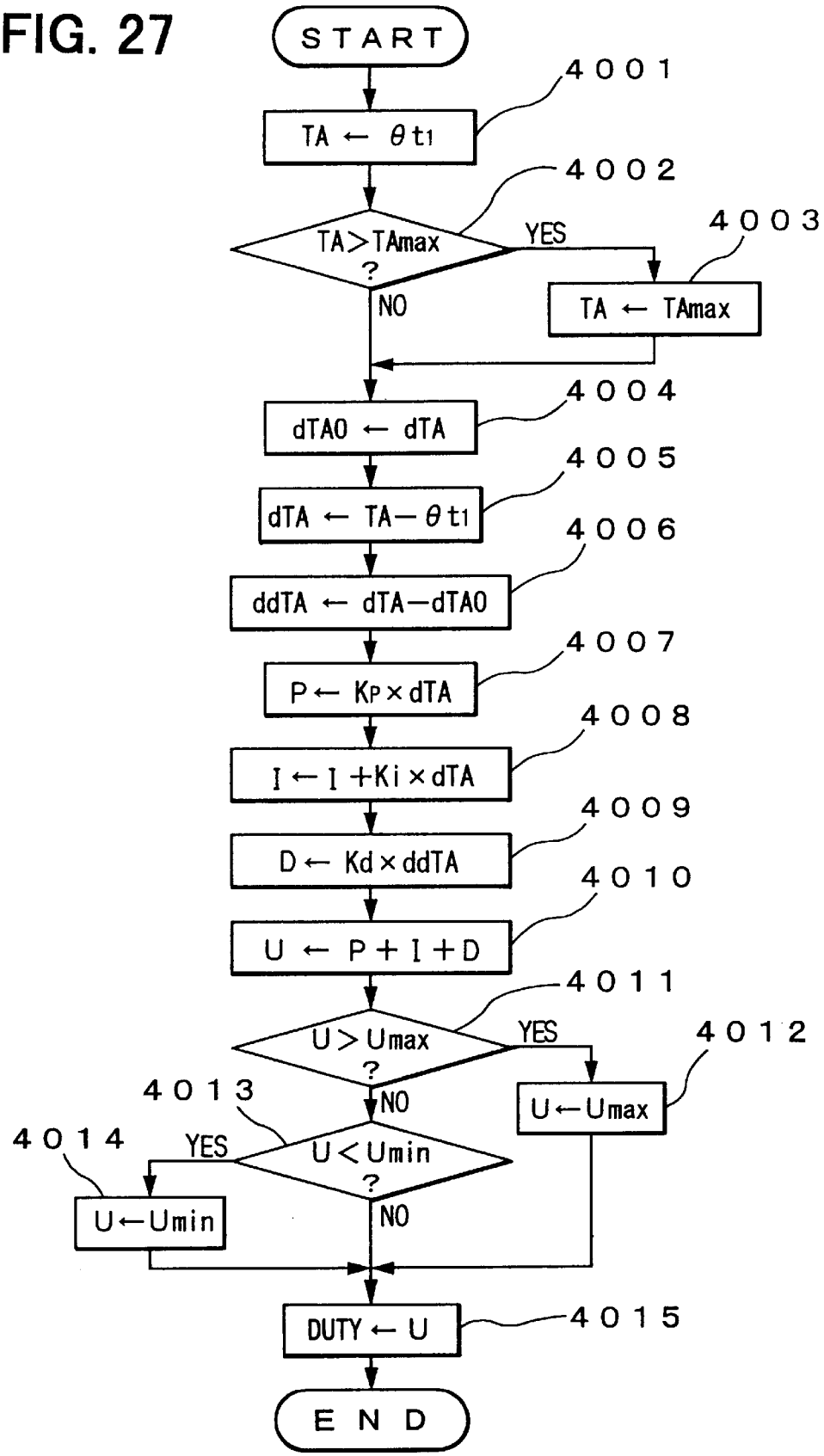
FIG. 27 is a flow diagram showing a procedure of normal control processing carried out in the second embodiment.

The procedure of the normal control processing carried out at the step 4000 of the flow diagram shown in FIG. 21 is the same as that in the first embodiment (FIG. 19). Therefore no description of FIG. 27 will be necessary.

Figure 28:
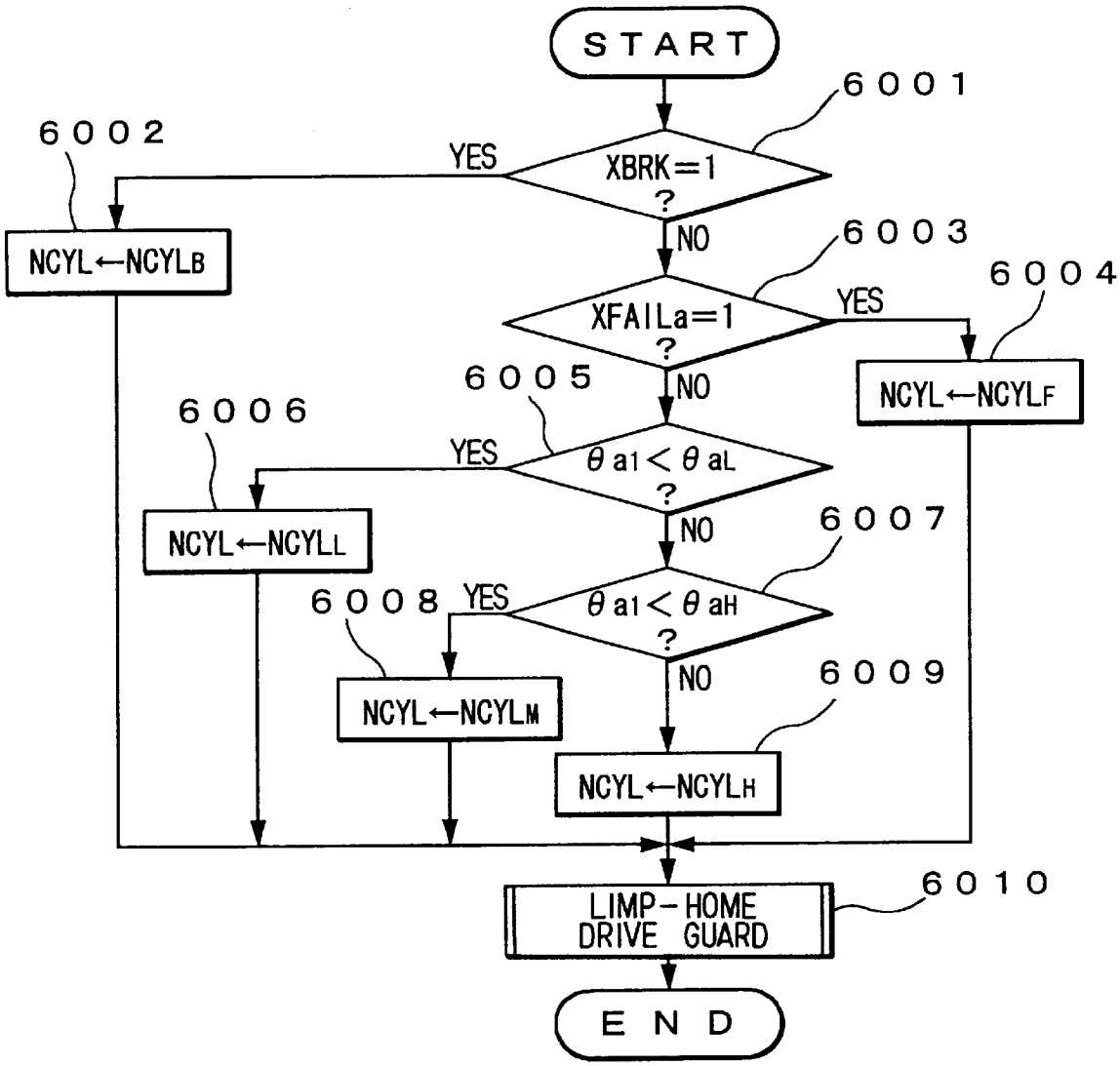
FIG. 28 is a flow diagram showing a procedure of limp-home operation processing carried out in the second embodiment.

Next, the procedure of the limp-home operation processing carried out at the step 6000 of the flow diagram shown in FIG. 21 is explained by referring to a flow diagram shown in FIG. 28. It should be noted that the subroutine of the limp-home operation processing is periodically executed by the CPU 31 at intervals of 10 ms when the XDOWN is set to 1.

As shown in FIG. 28, the flow diagram begins with a step 6001 to determine whether or not a brake-on flag XBRK is set to 1. If the condition of the determination at the step 6001 holds true, that is, if the brake-on flag XBRK is set to 1, indicating that foot pressure is applied to the brake pedal 23 to turn on the brake switch 24 and, hence, to put the vehicle in a braking operation, the flow of the procedure proceeds to a step 6002 at which the reduced cylinder number or count NCYL is set to a brake-on reduced cylinder count lower limit NCYLB. The reduced cylinder count NCYL is the number of operating cylinders which are maintained operative as normal, while other cylinders are held inoperative without air-fuel supply, so that the vehicle may be driven with the internal combustion engine operating with only a part of cylinders of the engine. Thus, the vehicle is driven to home or to repair shops in a limp-home manner.

If the condition of the determination at the step 6001 does not hold true, that is, if the brake-on flag XBRK is reset to 0 to indicate that no foot pressure is applied to the brake pedal 23, turning off the brake switch 24 and, hence, putting the internal combustion engine in a no-braking operation, the flow of the procedure proceeds to a step 6003 to determine whether the accelerator failure determination flag XFAILa is set to 1.

If the condition of the determination at the step 6003 holds true, that is, if the accelerator failure determination flag XFAILa is set to 1, indicating that the output state of at least the accelerator position sensors 22A and 22B of the other dual sensor system is abnormal, the flow of the procedure proceeds to a step 6004 at which the reduced cylinder count NCYL in the reduced-cylinder-count configuration implemented in the internal combustion engine is set to an accelerator failure reduced cylinder count NCYLF.

If the condition of the determination at the step 6003 does not hold true, that is, if the accelerator failure determination flag XFAILa is reset to 0, indicating that the output states of both the accelerator position sensors 22A and 22B of the other dual sensor system are normal, on the other hand, the flow of the procedure proceeds to a step 6005 to determine whether the accelerator position θa1 of the accelerator position sensor 22A determined at the step 1003 of the flow diagram shown in FIG. 3 is smaller than a lower accelerator position criterion value θaL. If the condition of the determination at the step 6005 holds true, that is, if the accelerator position θa1 is smaller than the lower accelerator position criterion value θaL, the flow of the procedure proceeds to a step 6006 at which the reduced cylinder count NCYL in the reduced-cylinder-count configuration implemented in the internal combustion engine is set to a lower accelerator position reduced cylinder count NCYLL.

If the condition of the determination at the step 6005 does not hold true, that is, if the accelerator position θa1 is equal to or greater than the lower accelerator position criterion value θaL, on the other hand, the flow of the procedure proceeds to a step 6007 to determine whether the accelerator position θa1 is smaller than a higher accelerator position criterion value θaH. If the condition of the determination at the step 6007 holds true, that is, if the accelerator position θa1 is smaller than the higher accelerator position criterion value θaH, the flow of the procedure proceeds to a step 6008 at which the reduced cylinder count NCYL in the reduced-cylinder-count configuration implemented in the internal combustion engine is set to a middle accelerator position reduced cylinder count NCYLM.

If the condition of the determination at the step 6007 does not hold true, that is, if the accelerator position θa1 is equal to or greater than the higher accelerator position criterion value θaH, on the other hand, the flow of the procedure proceeds to a step 6009 at which the reduced cylinder count NCYL in the reduced-cylinder-count configuration implemented in the internal combustion engine is set to a higher accelerator position reduced cylinder count NCYLH.

After the reduced cylinder count NCYL is set to the step 6002, 6004, 6006, 6008 or 6009, the flow of the procedure then proceeds to a step 6010 at which limp-home guard processing to be described later is carried out before this routine is ended.

Figure 29:
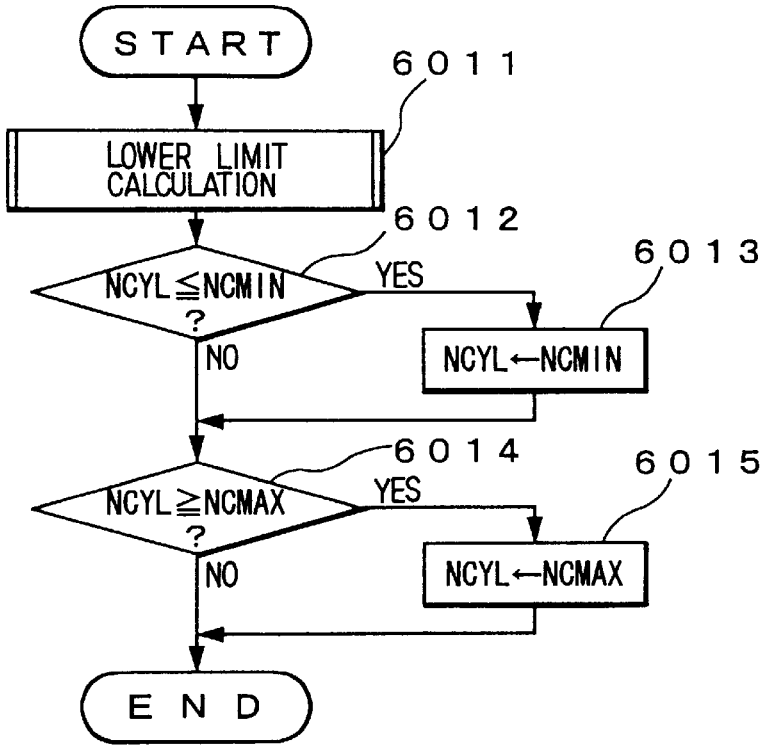
FIG. 29 is a flow diagram showing the procedure of limp-home guard processing carried out at a step in the flow diagram shown in FIG. 28.

Next, the procedure of the limp-home guard processing carried out at the step 6010 of the flow diagram shown in FIG. 28 is explained in detail by referring to a flow diagram shown in FIG. 29.

As shown in FIG. 29, the flow diagram begins with a step 6011 at which processing to calculate a lower limit of the reduced cylinder count to be described later is carried out. The flow of the procedure then proceeds to a step 6012 to determine whether the reduced cylinder count NCYL is equal to or smaller than a reduced cylinder count lower limit NCMIN which was calculated at the step 6011. If the condition of the determination at the step 6012 holds true, that is, if the reduced cylinder count NCYL is equal to or smaller than the reduced cylinder count lower limit NCMIN, the flow of the procedure proceeds to a step 6013 at which the reduced cylinder count NCYL is set to the reduced cylinder count lower limit NCMIN.

After completing the processing of the step 6013 or if the condition of the determination at the step 6012 does not hold true, that is, if the reduced cylinder count NCYL is greater than the reduced cylinder count lower limit NCMIN calculated at the step 6011, the flow of the procedure proceeds to a step 6014 to determine whether the reduced cylinder count NCYL is equal to or greater than a reduced cylinder count upper limit NCMAX which is the number of cylinders in the internal combustion engine.

If the condition of the determination at the step 6014 holds true, that is, if the reduced cylinder count NCYL is equal to or greater than the reduced cylinder count upper limit NCMAX, the flow of the procedure proceeds to a step 6015 at which the reduced cylinder count NCYL is set to the reduced cylinder count upper limit NCMAX. After completing the processing of the step 6015 or if the condition of the determination at the step 6014 does not hold true, that is, if the reduced cylinder count NCYL is smaller than the reduced cylinder count upper limit NCMAX, this routine is ended.

Figure 30:
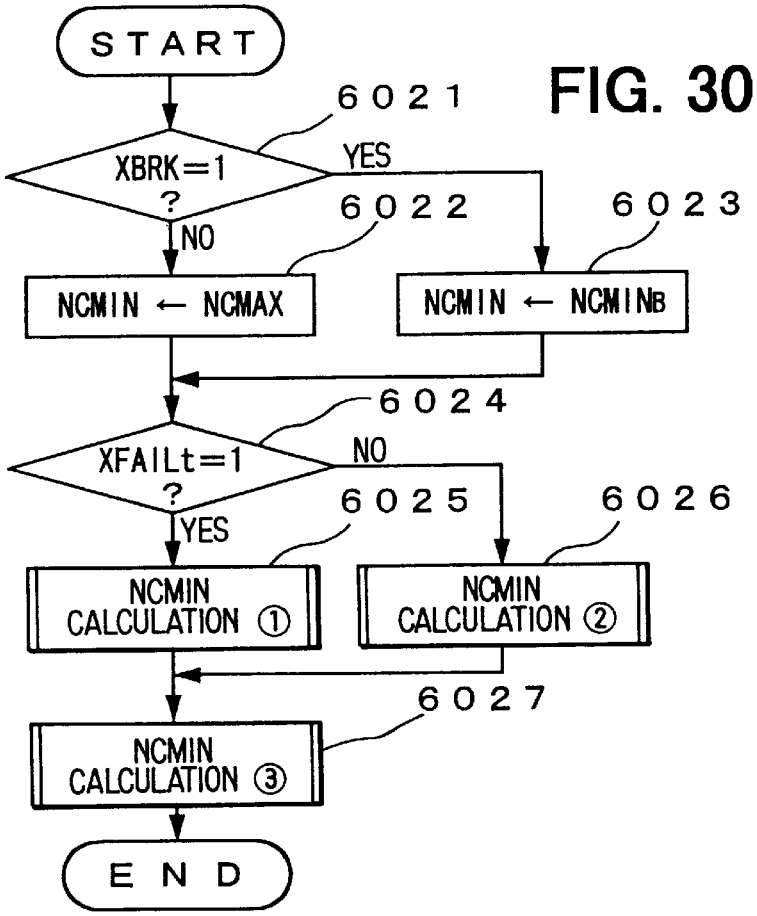
FIG. 30 is a flow diagram showing a procedure of processing carried out at a step in the flow diagram shown in FIG. 29 to calculate lower limits of the reduced number of operating cylinders.

Next, the procedure of processing carried out at the step 6011 of the flow diagram shown in FIG. 29 to calculate a lower limit of the reduced cylinder count is explained in detail by referring to a flow diagram shown in FIG. 30.

As shown in FIG. 30, the flow diagram begins with a step 6021 to determine whether the brake-on flag XBRK is set to 1. If the condition of the determination at the step 6021 does not hold true, that is, of the brake-on flag XBRK is reset to 0 to indicate that no foot pressure is applied to the brake pedal 23, turning off the brake switch 24 and, hence, putting the internal combustion engine in a no-braking operation, the flow of the procedure proceeds to a step 6022 at which the reduced cylinder count lower limit NCMIN as set to the reduced cylinder count upper limit NCMAX.

If the condition of the determination at the step 6021 holds true, that is, if the brake-on flag XBRK is set to 1, indicating that foot pressure is applied to the brake pedal 23 to turn on the brake switch 24 and, hence, to put the internal combustion engine in a braking operation, on the other hand, the flow of the procedure proceeds to a step 6023 at which the reduced cylinder count lower limit NCMIN as set to a brake-on reduced cylinder count lower limit NCMINB.

After the processing of the step 6022 or 6023 is completed, the flow of the procedure proceeds to a step 6024 to determine whether the throttle failure determination flag XFAILt is set to 1. If the condition of the determination of the step 6024 holds true, that is, if the throttle failure determination flag XFAILt is set to 1, indicating that at least one of the throttle angle sensors 16A and 16B of the dual sensor system is abnormal, the flow of the procedure proceeds to a step 6025 at which first processing to calculate the reduced cylinder count lower limit NCMIN to be described later is carried out.

If the condition of the determination of the step 6024 does not hold true, that is, if the throttle failure determination flag XFAILt is reset to 0, indicating that both the throttle angle sensors 16A and 16B of the dual sensor system are normal, on the other hand, the flow of the procedure proceeds to a step 6026 at which second processing to calculate the reduced cylinder count lower limit NCMIN to be described later is carried out. After the processing carried out at the step 6025 or 6026 is completed, the flow of the procedure proceeds to a step 6027 at which third processing to calculate the reduced cylinder count lower limit NCMIN to be described later is carried out. It should be noted that any of the first, second and third pieces of processing to calculate the reduced cylinder count lower limit NCMIN mentioned above can be combined.

Figure 31:
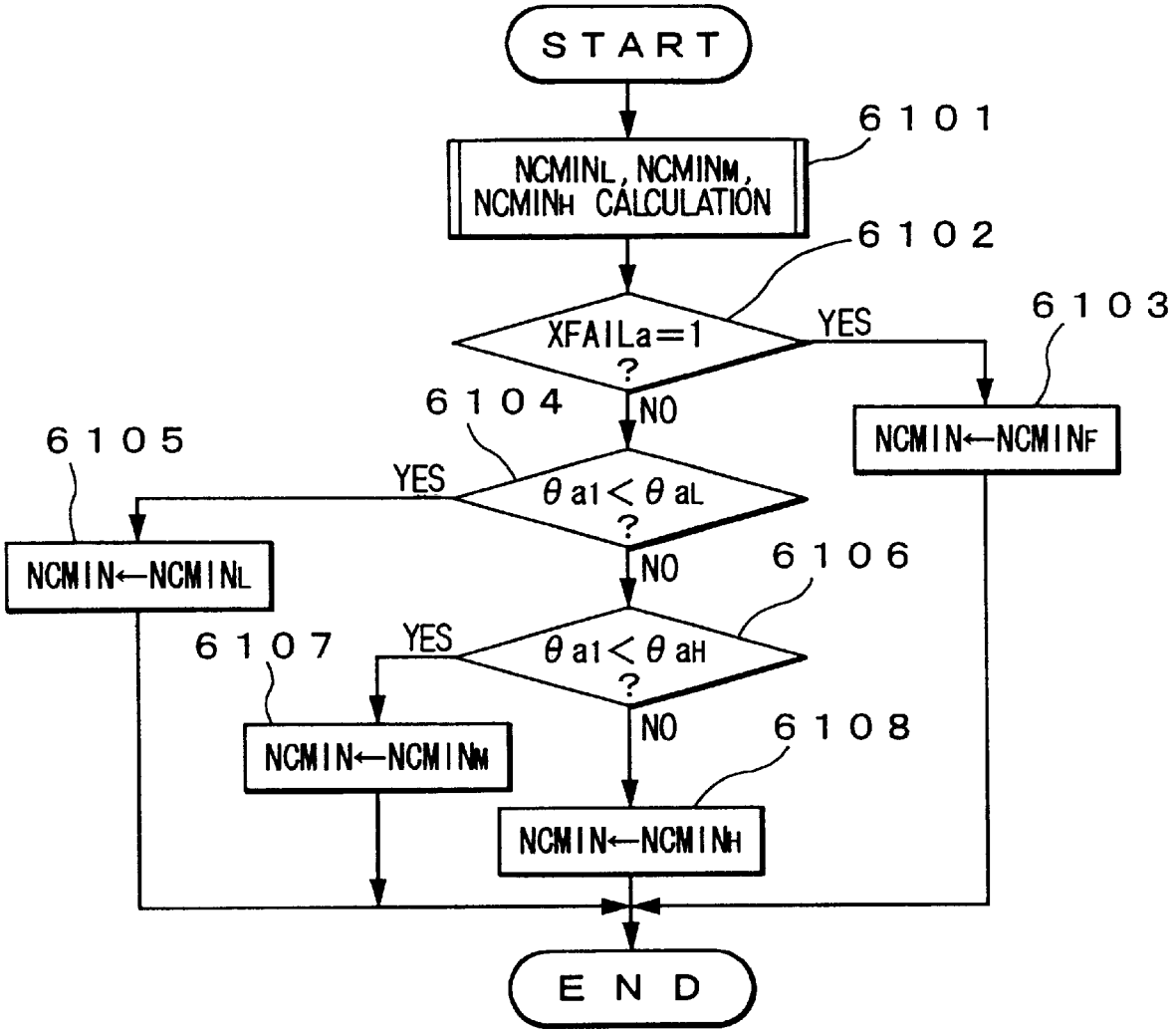
FIG. 31 is a flow diagram showing a procedure of first processing carried out at a step in the flow diagram shown in FIG. 30 to calculate a lower limit of the reduced number of operating cylinders.

Next, the procedure of the first processing carried out at the step 6025 of the flow diagram shown in FIG. 30 to calculate a reduced cylinder count lower limit NCMIN is explained in detail by referring to a flow diagram shown in FIG. 31.

As shown in FIG. 31, the flow diagram begins with a step 6101 to carry out processing to calculate a lower accelerator position reduced cylinder count lower limit NCMINL, a middle accelerator position reduced cylinder count lower limit NCMINM and a higher accelerator position reduced cylinder count lower limit NCMINH which will be described later. It should be noted that, instead of calculating the lower limits NCMINL, NCMINM and NCMINH, they can also each be set to a constant in advance.

Then, the flow of the procedure proceeds to a step 6102 to determine whether the accelerator failure determination flag XFAILa is set to 1. If the condition of the determination at the step 6102 holds true, that is, if the accelerator failure determination flag XFAILa is set to 1, indicating that the output state of at least the accelerator position sensors 22A and 22B of the other dual sensor system is abnormal, the flow of the procedure proceeds to a step 6103 at which the reduced cylinder count lower limit NCMIN is set to an accelerator failure reduced cylinder count lower limit NCMINF. Then, this routine is terminated.

If the condition of the determination at the step 6102 does not hold true, that is, if the accelerator failure determination flag XFAILa is reset to 0, indicating that the output states of both the accelerator position sensors 22A and 22B of the other dual sensor system are normal, on the other hand, the flow of the procedure proceeds to a step 6104 to determine whether the accelerator position θa1 of the accelerator position sensor 22A determined at the step 1003 of the flow diagram shown in FIG. 3 is smaller than the lower accelerator position criterion value θaL.

If the condition of the determination at the step 6104 holds true, that is, if the accelerator position θa1 is smaller than the lower accelerator position criterion value θaL, the flow of the procedure proceeds to a step 6105 at which the reduced cylinder count lower limit NCMIN is set to the lower accelerator position reduced cylinder count lower limit NCMINL determined at the step 6101. Then, this routine is terminated.

If the condition of the determination at the step 6104 does not hold true, that is, if the accelerator position θa1 is equal to or greater than the lower accelerator position criterion value θaL, on the other hand, the flow of the procedure proceeds to a step 6106 determine whether the accelerator position θa1 is smaller than the higher accelerator position criterion value θaH. If the condition of the determination at the step 6106 holds true, that is, if the accelerator position θa1 is smaller than the higher accelerator position criterion value θaH, the flow of the procedure proceeds to a step 6107 at which the reduced cylinder count lower limit NCMIN is set to the middle accelerator position reduced cylinder count lower limit NCMINM determined at the step 6101. Then, this routine is terminated.

If the condition of the determination at the step 6106 does not hold true, that is, if the accelerator position θa1 is equal to or greater than the higher accelerator position criterion value θaH, on the other hand, the flow of the procedure proceeds to a step 6108 at which the reduced cylinder count lower limit NCMIN is set to the higher accelerator position reduced cylinder count lower limit NCMINH determined at the step 6101. Then, this routine is terminated.

Figure 32:
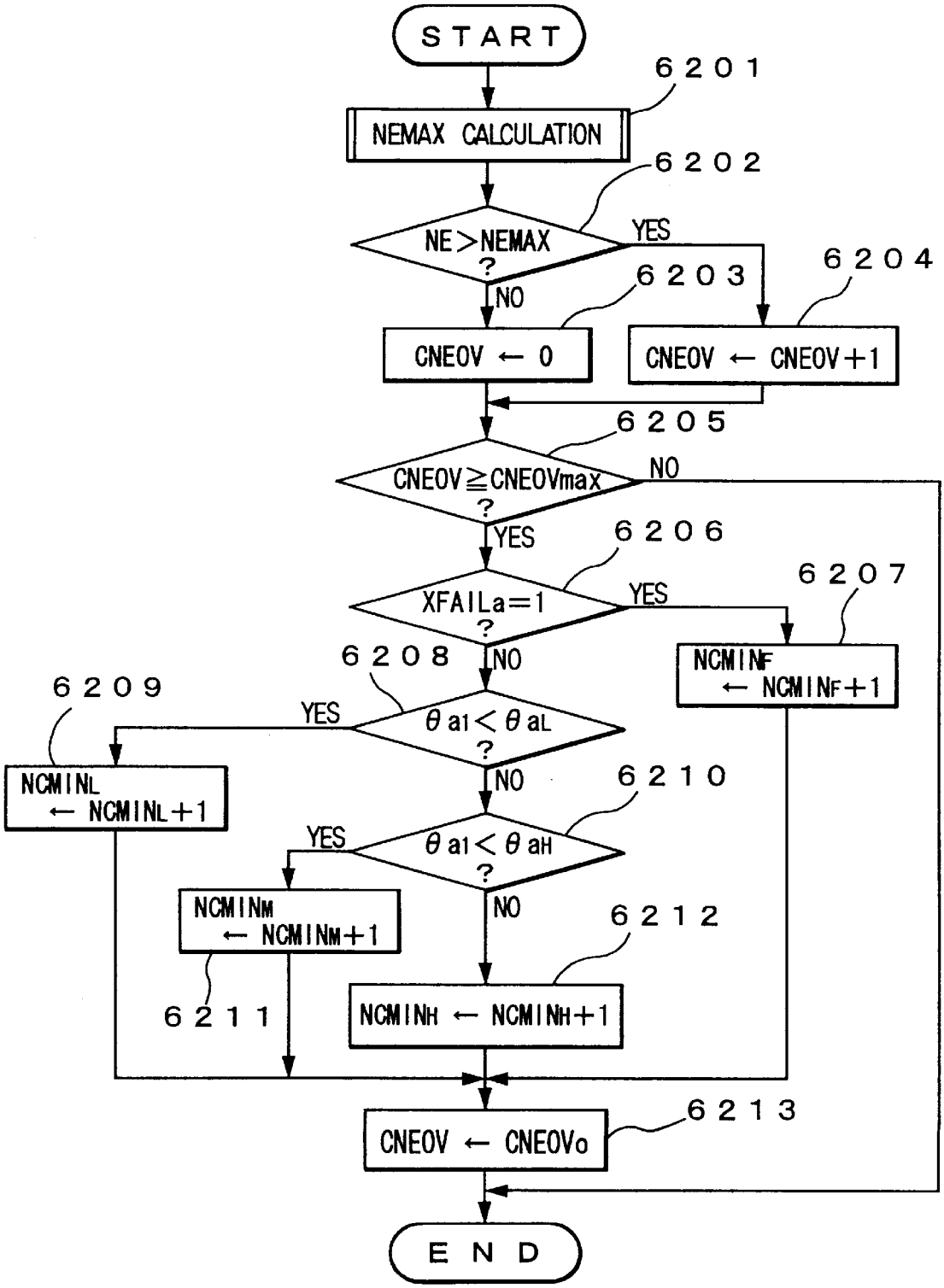
FIG. 32 is a flow diagram showing a procedure of processing carried out at a step in the flow diagram shown in FIG. 31 to calculate a lower accelerator position lower limit, a middle accelerator position lower limit and a higher accelerator position lower limit of the reduced number of operating cylinders.

Next, the procedure of the processing carried out at the step 6101 of the flow diagram shown in FIG. 31 to calculate a lower accelerator position reduced cylinder count lower limit NCMINL, a middle accelerator position reduced cylinder count lower limit NCMINM and a higher accelerator position reduced cylinder count lower limit NCMINH is explained in detail by referring to a flow diagram shown in FIG. 32.

As shown in FIG. 32, the flow diagram begins with a step 6201 to carry out processing to calculate an engine speed upper limit NEMAX to be described later. It should be noted, however, that the engine speed upper limit NEMAX can also be set to a constant value in advance. The flow of the procedure then proceeds to a step 6202 to determine whether the engine speed NE of the internal combustion engine is greater than the engine speed upper limit NEMAX set to the step 6101.

If the condition of the determination at the step 6202 does not hold true, that is, if the engine speed NE of the internal combustion engine is equal to or smaller than the engine speed upper limit NEMAX, the flow of the procedure proceeds to a step 6203 at which an upper limit engine speed over counter CNEOV is cleared to 0. If the condition of the determination at the step 6202 holds true, that is, if the engine speed NE of the internal combustion engine is greater than the engine speed upper limit NEMAX, on the other hand, the flow of the procedure proceeds to a step 6204 at which the upper limit engine speed over counter CNEOV is incremented by 1.

After the processing carried out at the step 6203 or 6204 is completed, the flow of the procedure proceeds to a step 6205 to determine whether the upper limit engine speed over counter CNEOV is equal to or greater than an upper limit engine speed over counter maximum CNEOVmax. If the condition of the determination at the step 6205 does not hold true, that is, if the upper limit engine speed over counter CNEOV is smaller than the upper limit engine speed over counter maximum CNEOVmax, this routine is terminated. If the condition of the determination at the step 6205 holds true, that is, if the upper limit engine speed over counter CNEOV is equal to or greater than the upper limit engine speed over counter maximum CNEOVmax, on the other hand, the flow of the procedure proceeds to a step 6206 to determine whether the accelerator failure determination flag XFAILa is set to 1.

If the condition of the determination at the step 6206 holds true, that is, if the accelerator failure determination flag XFAILa is set to 1, indicating that the output state of at least the accelerator position sensors 22A and 22B of the other dual sensor system is abnormal, the flow of the procedure proceeds to a step 6207 at which the accelerator failure reduced cylinder count lower limit NCMINF is incremented by 1.

If the condition of the determination at the step 6206 does not hold true, that is, if the accelerator failure determination flag XFAILa is reset to 0, indicating that the output states of both the accelerator position sensors 22A and 22B of the other dual sensor system are normal, on the other hand, the flow of the procedure proceeds to a step 6208 to determine whether the accelerator position θa1 of the accelerator position sensor 22A determined at the step 1003 of the flow diagram shown in FIG. 3 is smaller than the lower accelerator position criterion value θaL.

If the condition of the determination at the step 6208 holds true, that is, if the accelerator position θa1 is smaller than the lower accelerator position criterion value θaL, the flow of the procedure proceeds to a step 6209 at which the lower accelerator position reduced cylinder count lower limit NCMINL is incremented by 1.

If the condition of the determination at the step 6208 does not hold true, that is, if the accelerator position θa1 is equal to or greater than the lower accelerator position criterion value θaL, on the other hand, the flow of the procedure proceeds to a step 6210 determine whether the accelerator position θa1 is smaller than the higher accelerator position criterion value θaH.

If the condition of the determination at the step 6210 holds true, that is, if the accelerator position θa1 is smaller than the higher accelerator position criterion value θaH, the flow of the procedure proceeds to a step 6211 at which the middle accelerator position reduced cylinder count lower limit NCMINM is incremented by 1. If the condition of the determination at the step 6210 does not hold true, that is, if the accelerator position θa1 is equal to or greater than the higher accelerator position criterion value θaH, on the other hand, the flow of the procedure proceeds to a step 6212 at which the higher accelerator position reduced cylinder count lower limit NCMINH is incremented by 1.

After the processing carried out at the step 6207, 6209, 6211 or 6212 is completed, the flow of the procedure proceeds to a step 6213 at which the upper limit engine speed over counter CNEOV is restored to an upper limit engine speed over counter initial value CNEOV0.

Figure 33:
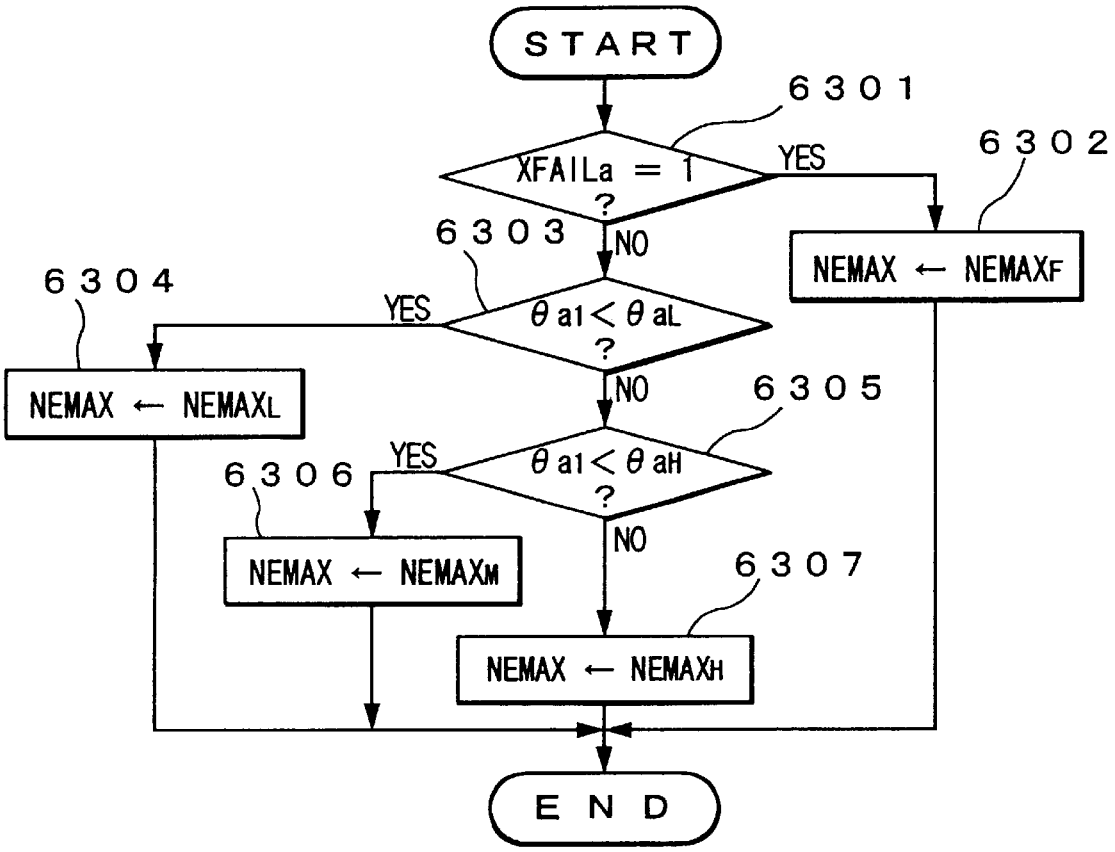
FIG. 33 is a flow diagram showing a procedure of processing carried out at a step in the flow diagram shown in FIG. 32 to calculate an upper limit of the engine speed of the internal combustion engine.

Next, the procedure of the processing carried out at the step 6201 of the flow diagram shown in FIG. 32 to calculate the engine speed upper limit NEMAX is explained in detail by referring to a flow diagram shown in FIG. 33.

As shown in FIG. 33, the flow diagram begins with a step 6301 to determine whether the accelerator failure determination flag XFAILa is set to 1. If the condition of the determination at the step 6301 holds true, that is, if the accelerator failure determination flag XFAILa is set to 1, indicating that the output state of at least the accelerator position sensors 22A and 22B of the other dual sensor system is abnormal, the flow of the procedure proceeds to a step 6302 at which the engine speed upper limit NEMAX is set to an accelerator failure engine speed upper limit NEMAXF. Then, this routine is terminated.

If the condition of the determination at the step 6301 does not hold true, that is, if the accelerator failure determination flag XFAILa is reset to 0, indicating that the output states of both the accelerator position sensors 22A and 22B of the other dual sensor system are normal, on the other hand, the flow of the procedure proceeds to a step 6303 to determine whether the accelerator position θa1 of the accelerator position sensor 22A determined at the step 1003 of the flow diagram shown in FIG. 3 is smaller than the lower accelerator position criterion value θaL. If the condition of the determination at the step 6303 holds true, that is, if the accelerator position θa1 is smaller than the lower accelerator position criterion value θaL, the flow of the procedure proceeds to a step 6304 at which the engine speed upper limit NEMAX is set to a lower accelerator position engine speed upper limit NEMAXL. Then, this routine is terminated.

If the condition of the determination at the step 6303 does not hold true, that is, if the accelerator position θa1 is equal to or greater than the lower accelerator position criterion value θaL, on the other hand, the flow of the procedure proceeds to a step 6305 determine whether the accelerator position θa1 is smaller than the higher accelerator position criterion value θaH. If the condition of the determination at the step 6305 holds true, that is, if the accelerator position θa1 is smaller than the higher accelerator position criterion value θaH, the flow of the procedure proceeds to a step 6306 at which the engine speed upper limit NEMAX is set to a middle accelerator position engine speed upper limit NEMAXM. Then, this routine is terminated.

If the condition of the determination at the step 6305 does not hold true, that is, if the accelerator position θa1 is equal to or greater than the higher accelerator position criterion value θaH, on the other hand, the flow of the procedure proceeds to a step 6307 at which the engine speed upper limit NEMAX is set to a higher accelerator position engine speed upper limit NEMAXH. Then, this routine is terminated.

Figure 34:
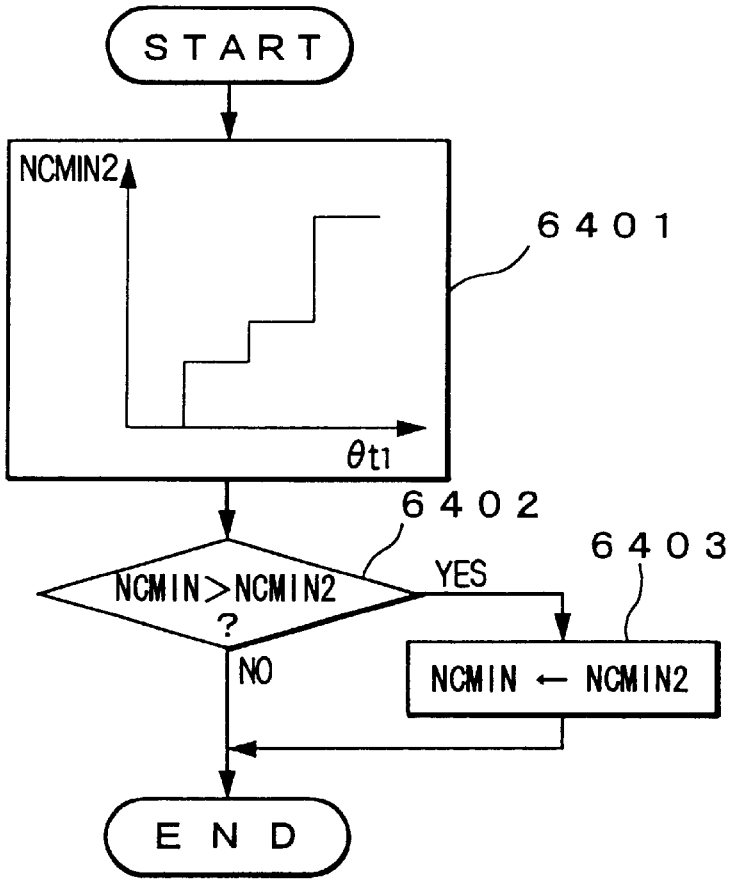
FIG. 34 is a flow diagram showing a procedure of second processing carried out at a step in the flow diagram shown in FIG. 30 to calculate the lower limit of the reduced number of operating cylinders.

Next, the procedure of the second processing carried out at the step 6026 of the flow diagram shown in FIG. 30 to calculate a reduced cylinder count lower limit NCMIN is explained in detail by referring to a flow diagram shown in FIG. 34.

As shown in FIG. 34, the flow diagram begins with a step 6401 at which a tentative reduced cylinder count lower limit NCMIN2 is determined from a map based on the throttle angle θt1 of the throttle angle sensor 16A determined at the step 1001 of the flow diagram shown in FIG. 3. The flow of the procedure then proceeds to a step 6402 to determine whether the reduced cylinder count lower limit NCMIN is greater than the tentative reduced cylinder count lower limit NCMIN2 determined at the step 6401.

If the condition of the determination at the step 6402 does not hold true, that is, if the reduced cylinder count lower limit NCMIN is equal to or smaller than the tentative reduced Cylinder count lower limit NCMIN2, this routine is terminated. If the condition of the determination at the step 6402 holds true, that is, if the reduced cylinder count lower limit NCMIN is greater than the tentative reduced cylinder count lower limit NCMIN2, on the other hand, the flow of the procedure then proceeds to a step 6403 at which the reduced cylinder count lower limit NCMIN is set to the tentative reduced cylinder count lower limit NCMIN2. Then, this routine is terminated.

Figure 35:
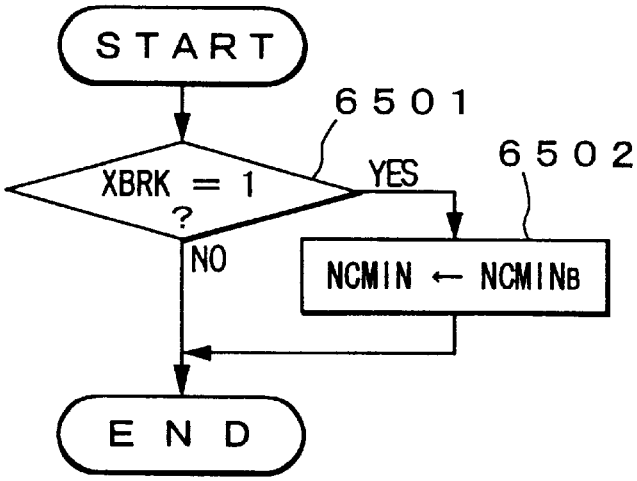
FIG. 35 is a flow diagram showing a procedure of third processing carried out at a step in the flow diagram shown in FIG. 30 to calculate the lower limit of the reduced number of operating cylinders.

Next, the procedure of the third processing carried out at the step 6027 of the flow diagram shown in FIG. 30 to calculate a reduced cylinder count lower limit NCMIN is explained in detail by referring to a flow diagram shown in FIG. 35.

As shown in FIG. 35, the flow diagram begins with a step 6501 to determine whether the brake-on flag XBRK is set to 1. If the condition of the determination at the step 6501 does not hold true, that is, if the brake-on flag XBRK is reset to 0, to indicate that no foot pressure is applied to the brake pedal 23, turning off the brake switch 24 and, hence, putting the internal combustion engine in a no-braking operation, this routine is just terminated.

If the condition of the determination at the step 6501 holds true, that is, if the brake-on flag XBRK is set to 1, indicating that foot pressure is applied to the brake pedal 23 to turn on the brake switch 24 and, hence, to put the internal combustion engine in a braking operation, on the other hand, the flow of the procedure proceeds to a step 6502 at which the reduced cylinder count lower limit NCMIN as set to a brake-on reduced cylinder count lower limit NCMINB.

As described above, in the throttle control apparatus according to the second embodiment, when a failure is detected in at least one of elements composing the control system of the internal combustion engine such as the accelerator position sensor 22A, the accelerator position sensor 22B, the throttle angle sensor 16A, throttle angle sensor 16B or the throttle valve 12, conduction of a current to the actuator 20 is halted. The target throttle angle upper limit TAmax of the target throttle angle TA is set to the usage range lower limit opening θtmin of the throttle angle θt1. In execution of a limp-home based on this fail-safe processing, the number of cylinders in reduced cylinder count control is constrained by the reduced cylinder count lower limit NCMIN so as to set the reduced number of cylinders involved in generation of an output of the internal combustion engine at a proper value. As a result, since the output of the internal combustion engine does not increase to an excessively high value, the vehicle can be prevented from performing an improper operation.

In addition, in accordance with the brake state detected by the brake switch 24 and the accelerator position θa1 detected by the accelerator position sensor 22A, the reduced cylinder count NCYL is set to the brake-on reduced cylinder count lower limit NCMINB, the lower accelerator position reduced cylinder count NCYLL, the middle accelerator position reduced cylinder count NCYLM or the higher accelerator position reduced cylinder count NCYLH. Thus, the number of cylinders involved in the generation of the output of the internal combustion engine is proper for an operation carried out by the driver on the brake pedal or the accelerator pedal. As a result, since the output of the internal combustion engine does not increase to an excessively high value, the vehicle can be prevented from performing an improper operation.

Furthermore, when the engine speed NE of the internal combustion engine detected by the engine speed sensor 25 becomes equal to or greater than the engine speed upper limit NEMAX used as an engine speed set in advance, the reduced cylinder count lower limit NCMIN is increased or the operations of all cylinders are halted. In this way, the number of cylinders in reduced cylinder count control is constrained by the reduced cylinder count lower limit NCMIN based on the engine speed NE of the internal combustion engine so as to set the reduced number of cylinders involved in generation of an output of the internal combustion engine at a proper value. As a result, since the output of the internal combustion engine does not increase to an excessively high value, the vehicle can be prevented from performing an improper operation.

Moreover, the engine speed upper limit NEMAX used as a predetermined engine speed is set to the lower accelerator position engine speed upper limit NEMAXL, the middle accelerator position engine speed upper limit NEMAXM or the higher accelerator position engine speed upper limit NEMAXH in accordance with the throttle angle θa1 detected by the accelerator position sensor 22A. Thus, the engine speed NE of the internal combustion engine is set to a proper value. As a result, since the output of the internal combustion engine does not increase to an excessively high value, the vehicle can be prevented from performing an improper operation.

In addition, the engine speed upper limit NEMAX used as a predetermined engine speed is set to a fixed engine speed upper limit NEMAXF when a failure is detected in the accelerator position sensor 22A serving as a configuration element used in setting the engine speed upper limit NEMAX, that is, when the accelerator failure determination flag XFAILa is set to 1. In this way, the engine speed NE of the internal combustion engine of the internal combustion engine can be constrained. As a result, since the output of the internal combustion engine does not increase to an excessively high value, the vehicle can be prevented from performing an improper operation.

Furthermore, the reduced cylinder count lower limit NCMIN is set to the lower accelerator position reduced cylinder count lower limit NCMINL, the middle accelerator position reduced cylinder count lower limit NCMINM or the higher accelerator position reduced cylinder count lower limit NCMINH in accordance with the accelerator position θa1 detected by the accelerator position sensor 22A. Thus, the reduced number of cylinders involved in generation of an output of the internal combustion engine is set to a proper value. As a result, since the output of the internal combustion engine does not increase to an excessively high value, the vehicle can be prevented from performing an improper operation.

Moreover, when a braking operation is detected by the brake switch 24, that is, when the brake-on flag XBRK is set to 1, the reduced cylinder count lower limit NCMIN is limited to the brake-on reduced cylinder count lower limit NCMINB without regard to a reduced cylinder count. That is, in a braking operation, the reduced cylinder count lower limit NCMIN is limited at the brake-on reduced cylinder count lower limit NCMINB without regard to the engine speed NE of the internal combustion engine. Thus, the reduced number of cylinders involved in generation of an output of the internal combustion engine is set to a proper value. As a result, since the output of the internal combustion engine does not increase to an excessively high value, the vehicle can be prevented from performing an improper operation.

The present invention having been described above should not be limited to the above embodiments, but may be implemented in many other ways. For instance, the dual throttle sensor system and the dual accelerator sensor system may be in a single sensor system, respectively. Further, the first embodiment and the second embodiment may be integrated into one control system.

What is claimed is:

1. A throttle control apparatus for an internal combustion engine comprising:

an accelerator position sensor for detecting an accelerator position according to a depression position of an accelerator pedal;

a throttle angle sensor for detecting an actual opening of a throttle valve as an actual throttle angle;

control variable calculation means for calculating a control variable for making the actual throttle angle detected by the throttle angle sensor match a target throttle angle on the basis of a deviation between the actual throttle angle and the target throttle angle which is a target opening of the throttle valve set in accordance with the accelerator position detected by the accelerator position sensor;

throttle control means for controlling the actual throttle angle by driving an actuator in accordance with the control variable calculated by the control variable calculation means;

failure detection means for detecting a failure in a throttle control;

fail-safe means for restraining an upper limit of the target throttle angle to be smaller than a predetermined value in the event of at least a failure detected in the throttle control apparatus; and restoration control means for restoring the target throttle angle restrained by the fail-safe means to a value used in a normal time when the throttle control means is restored to a normal state.

2. A throttle control apparatus as in claim 1, wherein:

the restoration control means restores the upper limit of the target throttle angle to a value used at a normal time when the target throttle angle becomes smaller than at least one of (a) the predetermined throttle angle and (b) the actual throttle angle.

3. A throttle control apparatus as in claim 1, wherein:

the restoration control means gradually increases an upper limit of the target throttle angle.

4. A throttle control apparatus as in claim 1, wherein:

the restoration control means limits an opening speed of the throttle valve only during a period in which the target throttle angle is greater than the actual throttle angle after the restoration control is started.

5. A throttle control apparatus as in claim 1, wherein:

the restoration control means limits an opening speed of the throttle valve only during a predetermined period after the restoration control is started.

6. A throttle control apparatus as in claim 1, wherein:

the restoration control means gradually relieves a limitation on an opening speed of the throttle valve.

7. A throttle control apparatus as in claim 1 further comprising:

reduced cylinder count control means for executing reduced cylinder count control by setting a reduced cylinder count indicating the number of operating cylinders of the internal combustion engine after processing carried out by the fail-safe means; and reduced cylinder count limitation means for setting a lower limit of the reduced cylinder count set by the reduced cylinder count control means in order to limit the number of operating cylinders.

8. A throttle control apparatus as in claim 7, further comprising:

brake detection means for detecting a state of a depression of a brake pedal, wherein the reduced cylinder count control means sets the reduced cylinder count in accordance with the state of a depression of the brake pedal detected by the brake detection means and the accelerator position detected by the accelerator position sensor.

9. A throttle control apparatus as in claim 7, further comprising:

an engine speed sensor for detecting an engine speed of the internal combustion engine, wherein the reduced cylinder count limitation control means increases the lower limit of the reduced cylinder count or halts operations of all cylinders when the engine speed detected by the engine speed sensor becomes greater than a predetermined engine speed.

10. A throttle control apparatus as in claim 9, wherein:

the reduced cylinder count limitation control means sets the predetermined engine speed in accordance with at least one of (a) the brake state detected by the brake detection means, (b) the accelerator position detected by the accelerator position sensor and (c) the actual throttle angle detected by the throttle angle sensor.

11. A throttle control apparatus as in claim 10, wherein:

the reduced cylinder count limitation control means sets the predetermined engine speed at a fixed engine speed when a failure is detected in any component used in setting the predetermined engine speed.

12. A throttle control apparatus as in claim 7, wherein:

the reduced cylinder count limitation control means sets the lower limit of the reduced cylinder count in accordance with at least one of (a) the accelerator position detected by the accelerator position sensor and (b) the actual throttle angle detected by the throttle angle sensor.

13. A throttle control apparatus as in claim 7, wherein:

the reduced cylinder count limitation control means sets at least one of (a) a limit of the lower limit of the reduced cylinder count at a predetermined value and (b) the reduced cylinder count at a fixed value without regard to: (i) a reduced cylinder count set by the reduced cylinder count control means and (ii) the reduced cylinder count limitation means when a braking operation is detected by brake detection means.

14. A throttle control apparatus for an internal combustion engine comprising:

an accelerator position sensor for detecting an accelerator position of an accelerator pedal;

a throttle angle sensor for detecting an actual opening of a throttle valve as an actual throttle angle;

control variable calculation means for calculating a control variable for making the actual throttle angle detected by the throttle angle sensor match a target throttle angle on the basis of a deviation between the actual throttle angle and the target throttle angle which is a target opening of the throttle valve set in accordance with the accelerator position detected by the accelerator position sensor;

throttle control means for controlling the actual throttle angle by driving an actuator in accordance with the control variable calculated by the control variable calculation means;

failure detection means for detecting a failure in a throttle control;

fail-safe means for restraining an upper limit of the target throttle angle to a value smaller than a predetermined value in the event of at least a failure detected in the throttle control;

reduced cylinder count control means for executing reduced cylinder count control by setting a reduced cylinder count indicating the number of operating cylinders of the internal combustion engine after processing carried out by the fail-safe means; and reduced cylinder count limitation means for setting a lower limit of the reduced cylinder count set by the reduced cylinder count control means in order to limit the number of operating cylinders.

15. A throttle control apparatus as in claim 14, further comprising:

brake detection means for detecting a state of a depression of a brake pedal, wherein the reduced cylinder count control means sets the reduced cylinder count in accordance with the state of a depression of the brake pedal detected by the brake detection means and the accelerator position detected by the accelerator position sensor.

16. A throttle control apparatus as in claim 14, further comprising:

an engine speed sensor for detecting an engine speed of the internal combustion engine, wherein the reduced cylinder count limitation control means increases the lower limit of the reduced cylinder count or halts operations of all cylinders when the engine speed detected by the engine speed sensor becomes greater than a predetermined engine speed.

17. A throttle control apparatus as in claim 16, wherein:

the reduced cylinder count limitation control means sets the predetermined engine speed in accordance with at least one of: (a) a brake state detected by brake detection means, (b) the accelerator position detected by the accelerator position sensor and (c) the actual throttle angle detected by the throttle angle sensor.

18. A throttle control apparatus as in claim 17, wherein:

the reduced cylinder count limitation control means sets the predetermined engine speed at a fixed engine speed when a failure is detected in any component used in setting the predetermined engine speed.

19. A throttle control apparatus as in claim 14 wherein:

the reduced cylinder count limitation control means sets the lower limit of the reduced cylinder count in accordance with atleast one of: (a) the accelerator position detected by the accelerator position sensor and (b) the actual throttle angle detected by the throttle angle sensor.

20. A throttle control apparatus as in claim 14, wherein:

the reduced cylinder count limitation control means sets at least one of: (a) a limit of the lower limit of the reduced cylinder count at a predetermined value and (b) the reduced cylinder count at a fixed value without regard to: (i) a reduced cylinder count set by the reduced cylinder count control means and (ii) the reduced cylinder count limitation means when a braking operation is detected by brake detection means.

* * * * *